US010138662B2

(12) United States Patent
Yun

(10) Patent No.: US 10,138,662 B2
(45) Date of Patent: Nov. 27, 2018

(54) LOCKING APPARATUS FOR SLIDING DOOR

(71) Applicant: HYUNDAI MOTOR COMPANY, Seoul (KR)

(72) Inventor: Hyung In Yun, Incheon (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 53 days.

(21) Appl. No.: 15/369,166

(22) Filed: Dec. 5, 2016

(65) Prior Publication Data

US 2018/0100335 A1 Apr. 12, 2018

(30) Foreign Application Priority Data

Oct. 10, 2016 (KR) ..... 10-2016-0130533

(51) Int. Cl.
*E05F 11/00* (2006.01)
*E05C 17/50* (2006.01)
(Continued)

(52) U.S. Cl.
CPC ..... *E05C 17/50* (2013.01); *E05B 77/54* (2013.01); *E05B 83/40* (2013.01); *E05F 5/003* (2013.01); *E05Y 2900/531* (2013.01)

(58) Field of Classification Search
CPC ..... E05C 17/50; E05F 5/003; E05B 83/40; E05B 77/54; E05Y 2900/531
(Continued)

(56) References Cited

U.S. PATENT DOCUMENTS 6,477,806 B1 * 11/2002 Asada ..... E05D 15/101 296/146.2
7,178,854 B2 * 2/2007 Ichinose ..... B60J 5/06 296/146.2
(Continued)

FOREIGN PATENT DOCUMENTS

KR 20050037128 A 4/2005
KR 20050055923 A 6/2005
(Continued)

*Primary Examiner* — Jerry E Redman
(74) *Attorney, Agent, or Firm* — McDonnell Boehnen Hulbert & Berghoff LLP

(57) ABSTRACT

The locking apparatus for sliding door is provided, the locking apparatus comprising a glass safety stopper and a hold-open lock striker sequentially provided in a vehicle body in an opening direction of the sliding door as it moves from a closed position to an open position. The apparatus further includes a roller bracket provided at the sliding door and a locking lever rotatably provided at the roller bracket. The locking lever has a locking protrusion configured to be locked to the glass safety stopper to limit movement of the sliding door in the opening direction and an engagement recess configured to be engaged with the hold-open lock striker to limit movement of the sliding door in the opening direction and a closing direction. A first elastic member is configured to bias the locking lever. The locking apparatus further includes a window glass lever rotatably provided at the roller bracket, connected to a window glass provided at the sliding door via a first cable, and configured to interlock with the locking lever. A second elastic member is configured to bias the glass lever. The locking apparatus further includes a connecting lever rotatably provided at the roller bracket, connected to a handle provided at the sliding door via a second cable, and configured to interlock with the locking lever.

27 Claims, 16 Drawing Sheets

(51) Int. Cl.
*E05B 77/54* (2014.01)
*E05B 83/40* (2014.01)
*E05F 5/00* (2017.01)

(58) Field of Classification Search
USPC ..... 49/360; 296/155
See application file for complete search history.

(56) References Cited

U.S. PATENT DOCUMENTS 7,288,907 B2 * 10/2007 Kamiya ..... B60J 5/06 296/146.2
7,472,944 B2 * 1/2009 Miyagawa ..... B60J 5/06 296/155
7,644,976 B2 * 1/2010 Suzuki ..... B60J 5/0497 292/216
7,782,001 B2 * 8/2010 Herwig ..... B60J 5/06 318/266
8,567,129 B2 * 10/2013 Suzuki ..... E05B 81/20 49/139
9,021,742 B2 * 5/2015 Mizuma ..... E05F 15/643 49/358
9,688,124 B1 * 6/2017 Okuma ..... B60J 5/0493
2003/0116995 A1 * 6/2003 Yogo ..... B60J 5/06 296/155
2004/0194385 A1 * 10/2004 Ichinose ..... E05F 5/003 49/26
2005/0081449 A1 * 4/2005 Choi ..... E05F 11/483 49/360
2006/0168891 A1 * 8/2006 Aoyama ..... E05F 15/603 49/360
2007/0107313 A1 * 5/2007 Suzuki ..... E05F 15/41 49/360
2007/0138832 A1 * 6/2007 Kraus ..... B60J 1/17 296/155
2014/0245666 A1 * 9/2014 Ishida ..... B60J 5/06 49/349
2014/0365080 A1 * 12/2014 Hirota ..... E05F 15/632 701/49
2015/0020450 A1 * 1/2015 Shibayama ..... E05B 83/40 49/31
2015/0057895 A1 * 2/2015 Yamada ..... E05F 15/70 701/49
2016/0201377 A1 * 7/2016 Nishikibe ..... B60J 5/047 49/28
2016/0208538 A1 * 7/2016 Nishikibe ..... E05F 15/632
2016/0237733 A1 * 8/2016 Henseleit ..... B60J 5/047

FOREIGN PATENT DOCUMENTS

KR 20070096435 A 10/2007
KR 20140006529 A 1/2014

* cited by examiner

LOCKING APPARATUS FOR SLIDING DOOR

CROSS-REFERENCE TO RELATED APPLICATION

This application claims the benefit of Korean Patent Application No. 10-2016-0130533, filed on Oct. 10, 2016 in the Korean Intellectual Property Office, the disclosure of which is incorporated herein by reference.

BACKGROUND

1. Field of the Disclosure

The present disclosure relates to a locking apparatus for a sliding door, and more particularly, to a locking apparatus for a sliding door that is capable of preventing the sliding door from completely opening while a window is open and from closing by itself due to an incline, thereby promoting safety and convenience of a passenger.

2. Description of the Related Art

Nowadays, vehicles of various sizes and types are being developed and sold to fit consumers' individual tastes. A recreational vehicle ("RV") having three or more rows of seats, a boxcar having a larger overall height and indoor space compared to regular vehicles, etc. are gaining popularity among consumers.

RVs, boxcars, and similar types of vehicles employ a sliding door structure, in which a door is opened and closed along a longitudinal direction of a vehicle, for convenience of getting in and out of back seats, rather than a driver's seat or a front passenger seat. Generally, a sliding door has a structure in which a guide rail is installed in a vehicle body along a longitudinal direction of a vehicle and a roller sliding along the guide rail is mounted on the sliding door so that the door is opened and closed when the roller of the door slides along the guide rail in the vehicle body.

Meanwhile, when a sliding door is open and a vehicle is stopped on an inclined road such as on a downhill, there is a concern that the sliding door may move in the closing direction and slide shut by itself due to self-load. In this case, there is a danger that a part of a passenger's body may become stuck between the sliding door and a vehicle body. Further, there is a problem in that user convenience is decreased because the sliding door needs to be continuously held open when a passenger is getting in and out of a vehicle or when loading and unloading things into and from the vehicle while the vehicle is tilted due to a sloping ground. Thus, a hold-open lock feature that prevents a sliding door in its open position from closing by itself due to a sloping ground is required for the sliding door.

Also, when a sliding door is open and a part of a passenger's body such as the passenger's head, arm, etc. is extending out of the open window of a vehicle, there is a danger that the part of the passenger's body may become stuck between the sliding door and a vehicle body. Thus, in addition to the hold-open lock feature described above, a glass safety lock feature that prevents a sliding door from completely opening while a window is open is required for the sliding door.

A conventional sliding door has devices installed on a vehicle body and the sliding door that enable the hold-open lock feature and the glass safety lock feature. However, the required structure becomes complicated because separate devices for performing the features need to be installed, and maintenance and repair of the product become difficult due to the complicated structure. Also, although improvement of space utilization as well as weight reduction is a factor that has a great influence on consumers when making purchase decisions nowadays, conventional devices have problems in that weight of the product increases due to increasing number of parts for performing each feature. Further, difficulty exists in designing and arranging parts because many parts with complicated structures must all be mounted in a narrow space between a vehicle body and a sliding door.

SUMMARY OF THE DISCLOSURE

An embodiment of the present disclosure is directed to a locking apparatus for a sliding door that is a single structure capable of simultaneously implementing a hold-open lock feature and a glass safety lock feature of the sliding door.

An embodiment of the present disclosure is directed to a locking apparatus for a sliding door that, due to decreased number of parts for implementing a feature, is capable of being easily manufactured, installed, maintained, and repaired.

An embodiment of the present disclosure is directed to a locking apparatus for a sliding door capable of improving safety and convenience of a passenger.

An embodiment of the present disclosure is directed to a locking apparatus for a sliding door capable of reducing vehicle weight and improving operating convenience of a passenger by reducing weight of the product.

An embodiment of the present disclosure is directed to a locking apparatus for a sliding door capable of improving space utilization and design flexibility due to being easily installable in a narrow space between a vehicle body and the sliding door.

An embodiment of the present disclosure is directed to a locking apparatus for a sliding door in which a manufacturing cost is reduced and productivity is improved.

An embodiment of the present disclosure is directed to a locking apparatus for a sliding door in which performance and operational reliability are improved.

In accordance with one aspect of the present disclosure, a locking apparatus for a sliding door of a vehicle, the locking apparatus comprising, a window glass safety stopper and a hold-open lock striker sequentially provided on the body of the vehicle in an opening direction of the sliding door as it moves from a closed position to an open position. The locking apparatus further includes a roller bracket provided at the sliding door; a locking lever rotatably provided on the roller bracket and having a locking protrusion configured to be locked to the window glass safety stopper to limit movement of the sliding door in the opening direction; and an engagement recess configured to be engaged with the hold-open lock striker to limit movement of the sliding door in the opening direction and a closing direction. A first elastic member is configured to bias the window locking lever. The locking apparatus further includes a window glass lever rotatably provided on the roller bracket, connected to a window glass provided at the sliding door via a first cable, and configured to interlock with the locking lever; a second elastic member configured to bias the window glass lever; and a connecting lever rotatably provided on the roller bracket, connected to a handle provided at the sliding door via a second cable, and configured to interlock with the locking lever.

The locking apparatus further comprises a first interlocker configured to interlock the locking lever with the window glass lever, wherein the first interlocker includes a first slot provided at the locking lever and a protrusion provided at the window glass lever and inserted into the first slot to interlock rotation of the locking lever in one direction with rotation of the window glass lever when the window glass lever rotates in the one direction. A third elastic member is configured to bias the connecting lever.

The locking apparatus further comprises a second interlocker configured to interlock the locking lever with the connecting lever. The second interlocker is rotatably provided at the roller bracket and includes a latch lever having one end configured to restrict or allow rotation of the locking lever in an other direction; a first intermediary member having one end rotatably connected to the other end of the connecting lever and a second slot provided at the other end; and a second intermediary member rotatably connected to the other end of the latch lever and configured to be rotatable in the second slot. The second interlocker further includes a fourth elastic member configured to bias the latch lever.

The locking apparatus further comprises a lever stopper configured to limit an amount of rotation of the locking lever. The locking lever includes a first seating portion configured to contact the latch lever and a second seating portion configured to contact the lever stopper. A cable bracket is configured to support the first cable and the second cable on the roller bracket.

The hold-open lock striker is provided on the vehicle body at a position corresponding to a position of the locking lever when the sliding door is in the open position. The window glass safety stopper is provided on the vehicle body at a position corresponding to a position of the locking lever when the sliding door is between the open position and the closed position. The hold-open lock striker includes a striker bracket supported by the vehicle body and a pole protruding from the striker bracket configured to be seated in the engagement recess.

The window glass safety stopper includes a stopper bracket supported by the vehicle body and a limiter protruding from the stopper bracket configured to contact the locking protrusion. The locking protrusion is positioned closer to the vehicle body than the engagement recess. The lever stopper includes a damper configured to attenuate an impact due to contact with the locking lever.

In accordance with one aspect of the present disclosure, a locking apparatus for a sliding door of a vehicle, the sliding door having a window with a window glass movable between an open position and a closed position, the locking apparatus comprising: a window glass safety stopper and a hold-open lock striker sequentially provided in a body of the vehicle in an opening direction of the sliding door as it moves from a closed position to an open position. The locking apparatus further includes a roller bracket provided at the sliding door; a locking lever rotatably provided at the roller bracket, having a locking protrusion configured to be locked to the window glass safety stopper to limit movement of the sliding door in the opening direction and an engagement recess configured to be engaged with the hold-open lock striker to limit movement of the sliding door in the opening direction and a closing direction, and configured to rotate in a first direction to protrude toward the vehicle body while a window glass is in its open position so that the locking protrusion is locked to the window glass safety stopper. A first elastic member is configured to bias the locking lever in a second direction to be inserted into the sliding door. The locking apparatus further includes a window glass lever rotatably provided at the roller bracket, connected to the window glass via a first cable, and configured to interlock with the locking lever when the window glass is in its open position so that the locking lever rotates in the first direction. A second elastic member is configured to bias the glass lever in the first direction.

With the window glass in its closed position, the locking lever passes by the window glass safety stopper, with the hold-open lock striker engaged with the engagement recess thereof, and rotates in the first direction.

The locking apparatus further comprises a connecting lever rotatably provided on the roller bracket, connected to a handle provided at the sliding door via a second cable, and configured to interlock with the locking lever, and a first interlocker. The first interlocker includes a first slot provided at the locking lever and a protrusion provided at the window glass lever and inserted into the first slot to interlock rotation of the locking lever in the first direction with rotation of the window glass lever when the window glass lever rotates in the first direction. A third elastic member is configured to bias the connecting lever in the first direction.

The locking apparatus further comprises a second interlocker configured to interlock the locking lever with the connecting lever. The second interlocker is rotatably provided at the roller bracket and includes a latch lever having one end configured to restrict or allow rotation of the locking lever in the second direction while one end thereof is in contact with the locking lever and the locking lever is rotated in the first direction; a first intermediary member having one end rotatably connected to the other end of the connecting lever and a second slot provided at the other end; and a second intermediary member rotatably connected to the other end of the latch lever and provided to be rotatable in the second slot. The second interlocker further includes a fourth elastic member configured to bias the latch lever in the first direction.

The locking apparatus further comprises a lever stopper configured to limit an amount of rotation of the locking lever in the first direction. The locking lever includes a first seating portion configured to come into contact with the latch lever and a second seating portion configured to come into contact with the lever stopper. A cable bracket is configured to support the first cable and the second cable on the roller bracket.

The hold-open lock striker includes a striker bracket supported by the vehicle body and a pole protruding from the striker bracket to be seated on the engagement recess. The window glass safety stopper includes a stopper bracket supported by the vehicle body and a limiter protruding from the stopper bracket to come into contact with the locking protrusion. The locking protrusion is positioned to be closer to the vehicle body than the engagement recess. The lever stopper includes a damper configured to attenuate an impact due to contact with the locking lever.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Exemplary embodiments of the present disclosure are described in detail with reference to the accompanying drawings. The same reference numbers are used throughout the drawings to refer to the same or like parts. Detailed descriptions of well-known features and structures incorporated herein may be omitted to avoid obscuring the subject matter of the present disclosure. Other exemplary embodiments or features may further be utilized, and other changes may be made, without departing from the scope of the subject matter presented herein. The exemplary embodiments described herein are not meant to be limiting. Thus, aspects of the present disclosure, as generally described herein and illustrated in the figures, can be arranged, substituted, combined, separated and designed in a wide variety of different configurations, all of which are explicitly contemplated herein.

Figure 1:
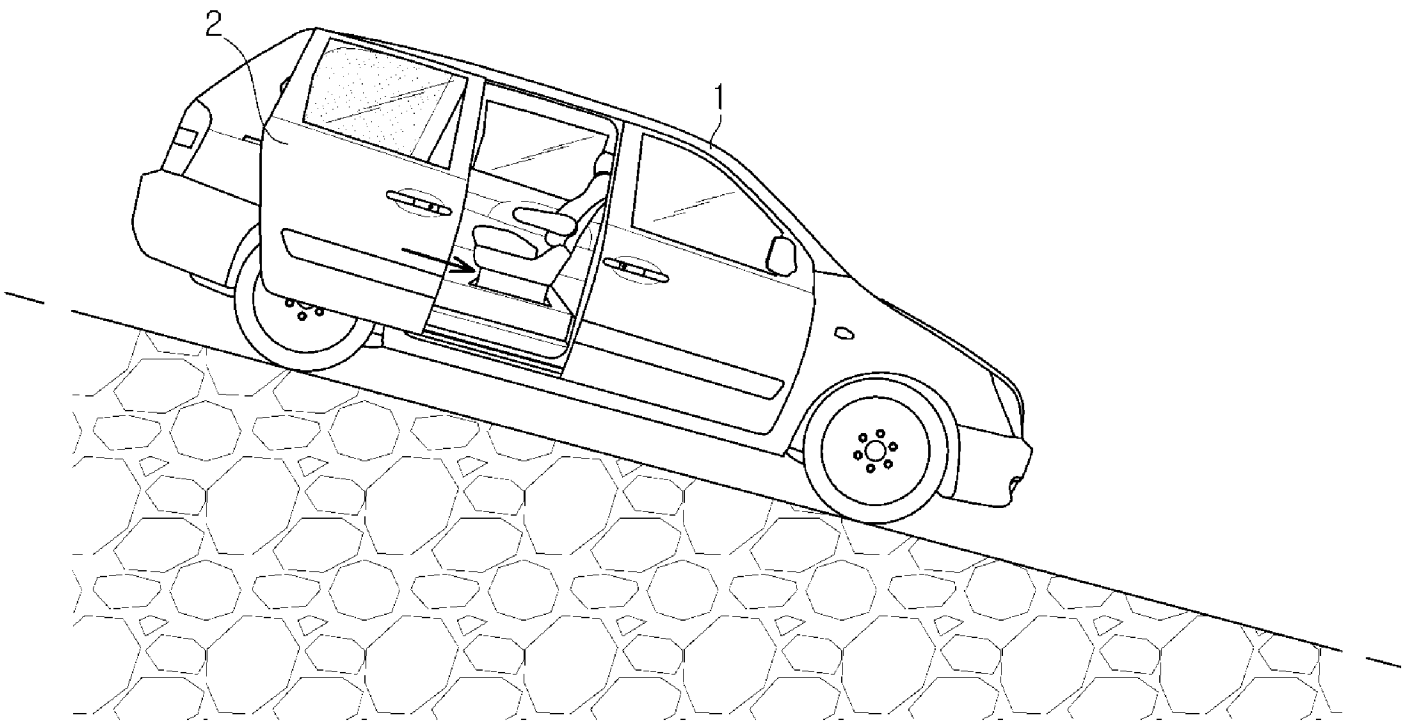
FIG. 1 is a view for describing a hold-open lock feature of a sliding door.
Figure 2:
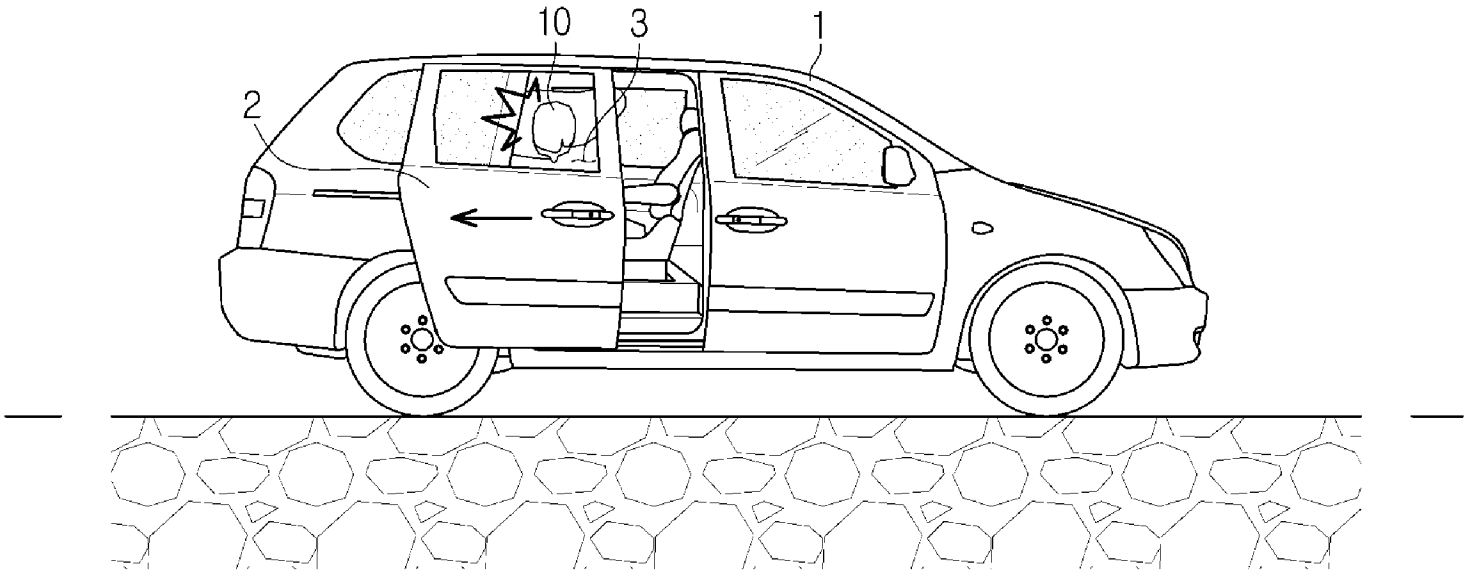
FIG. 2 is a view for describing a window safety lock feature of the sliding door.

FIG. 1 depicts a hold-open lock feature of a sliding door 2, and FIG. 2 depicts a glass safety lock feature of the sliding door 2.

Referring to FIG. 1, generally, the sliding door 2 of a recreational vehicle ("RV"), a boxcar, or a similar type of vehicle is installed adjacent the back seats of the vehicle, rather than adjacent to a driver's seat or a front passenger seat. The sliding door moves in a longitudinal direction of a vehicle between an opened and a closed position. When the sliding door 2 is in the opened position and the vehicle is stopped on an inclined road such as a downhill, there is a concern that the sliding door 2 may move to the closed position by itself in the sloped direction of the ground due to self-load (shown by the arrow in FIG. 1). In this case, there is a danger that a part of a passenger's body may be stuck between the sliding door 2 and a vehicle body 1. Thus, user convenience is decreased because the sliding door 2 needs to be continuously held when a passenger is getting in and out of the vehicle or when things are loaded and unloaded into and from the vehicle while the vehicle is on an incline due to the slope of the ground. Thus, a hold-open lock feature is required that prevents the sliding door 2 that is in the opened position from closing by itself due to the slope of the ground in order to improve safety and convenience of a passenger.

Referring to FIG. 2, when the sliding door 2 is in the opened position and a part of a passenger's body 10 such as the passenger's head, arm, etc. extends out of or is placed into the vehicle through an open window, there is a concern for injury due to part of the passenger's body 10 being stuck between the window of the sliding door 2 and the vehicle body 1. Thus, a window safety lock feature is required that prevents the sliding door 2 from completely opening (or moving in the direction of the arrow in FIG. 2) while the window 3 of the sliding door 2 is in the opened position.

Accordingly, a locking apparatus 100 for a sliding door according to an embodiment of the present disclosure is provided to simultaneously implement the hold-open lock feature and the window safety lock feature of the sliding door 2 described above by a single lever member 140.

Figure 3:
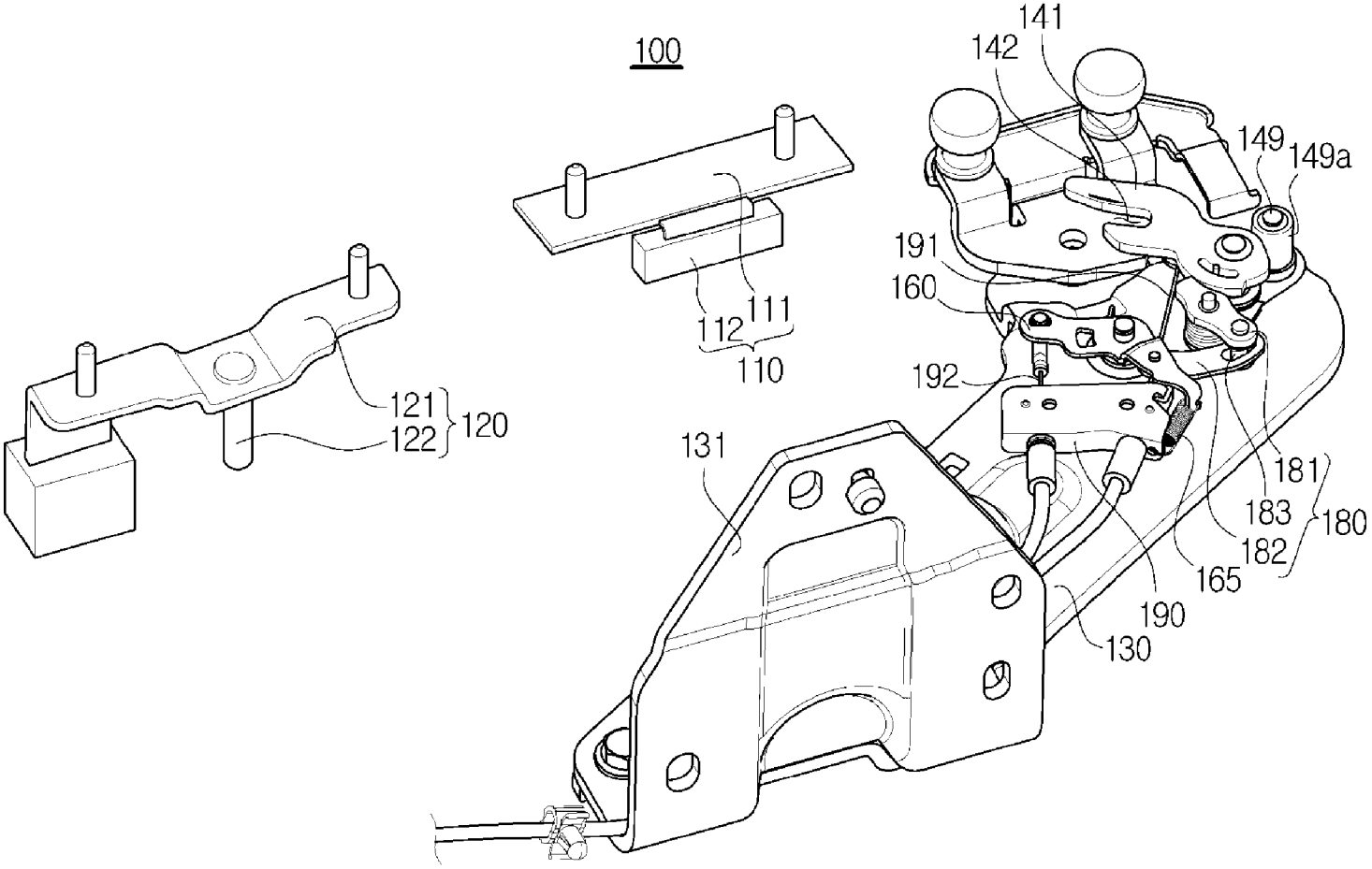
FIG. 3 is a perspective view illustrating the locking apparatus 100 of a sliding door according to an embodiment of the present disclosure.
Figure 4:
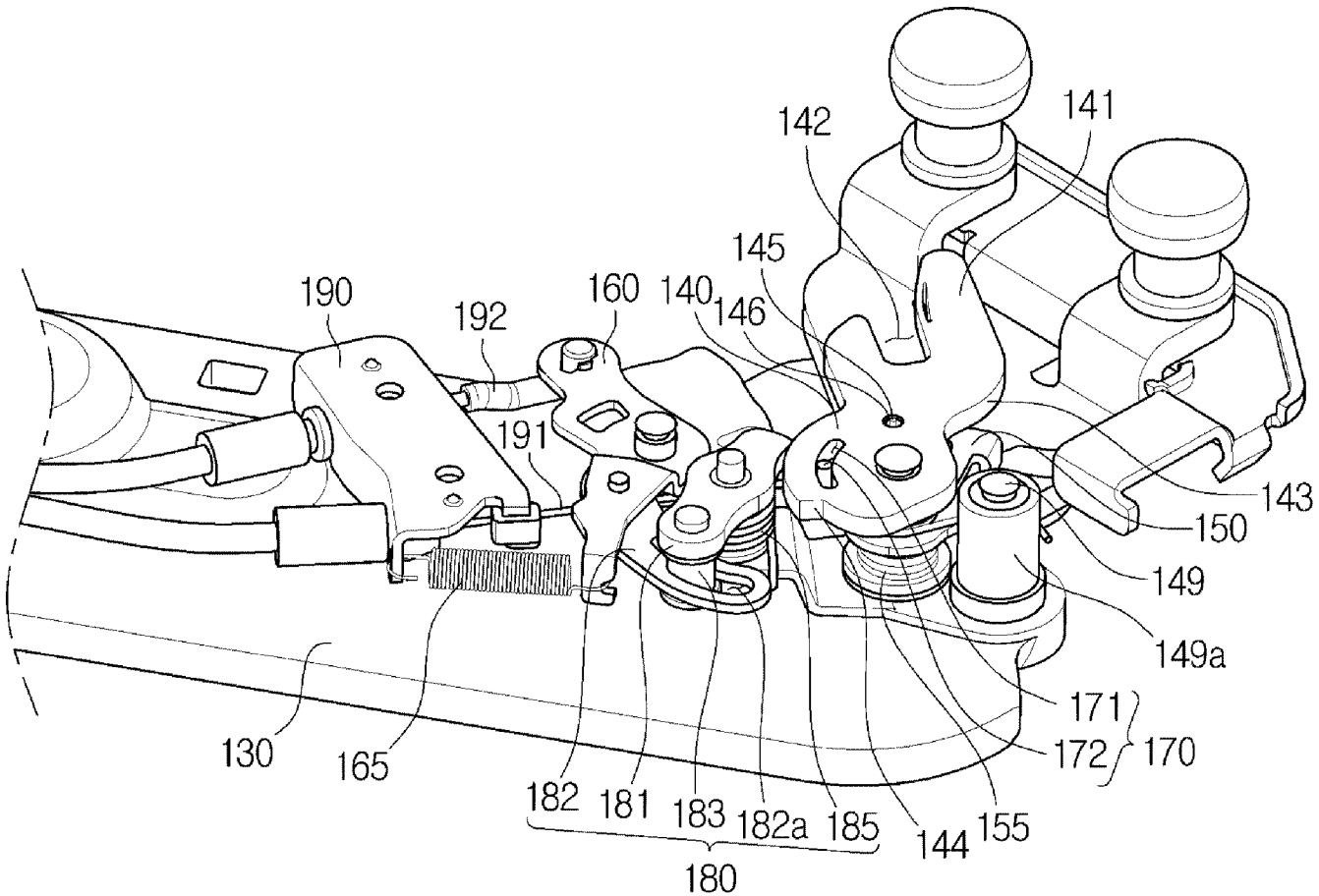
FIG. 4 is an alternate perspective view of the locking apparatus 100 of a sliding door according to an embodiment of the present disclosure.
Figure 5:
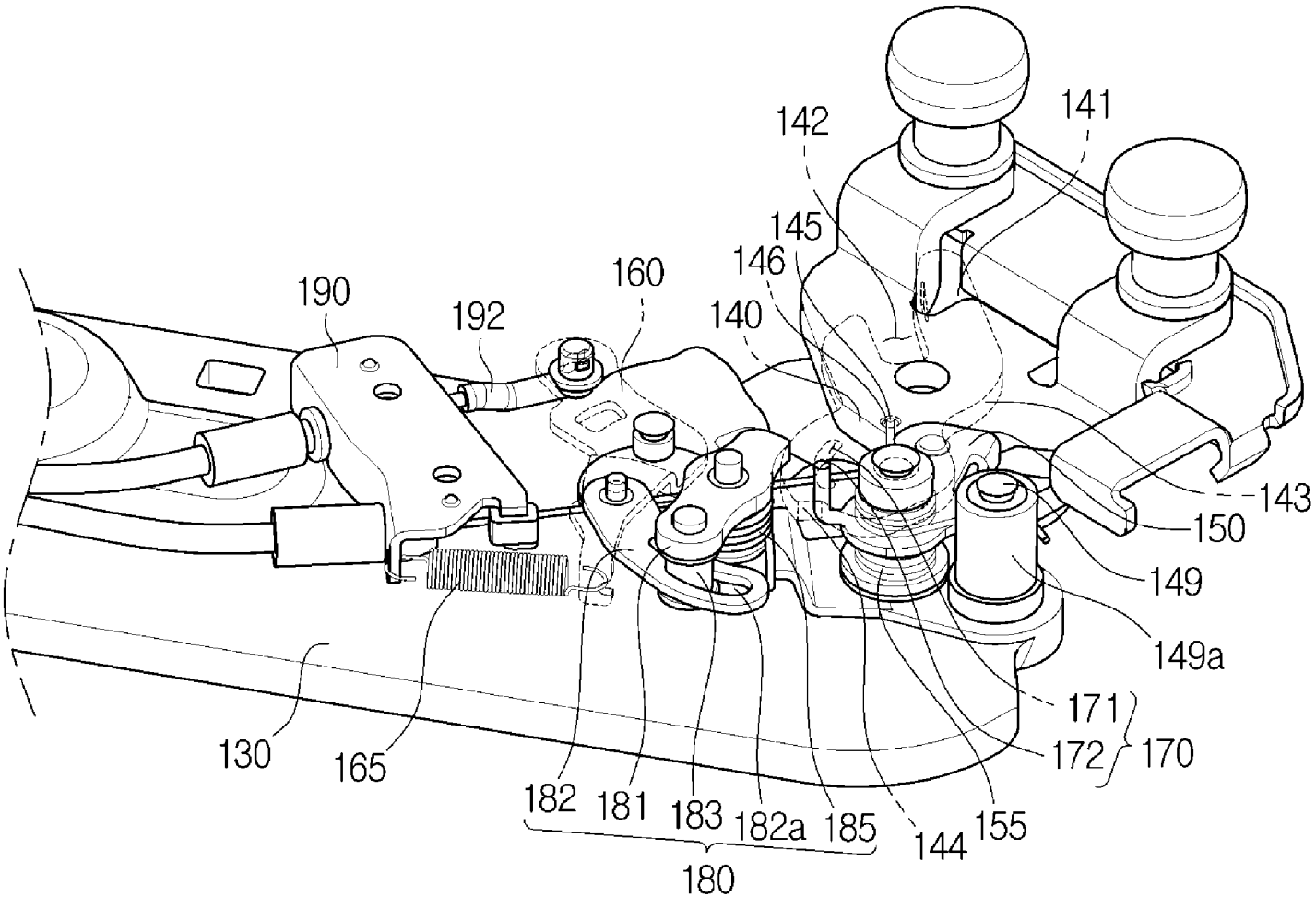
FIG. 5 is a perspective view of the locking apparatus 100 of FIG. 4 with the locking lever 140 and a connecting lever 160 shown in phantom.
Figure 6:
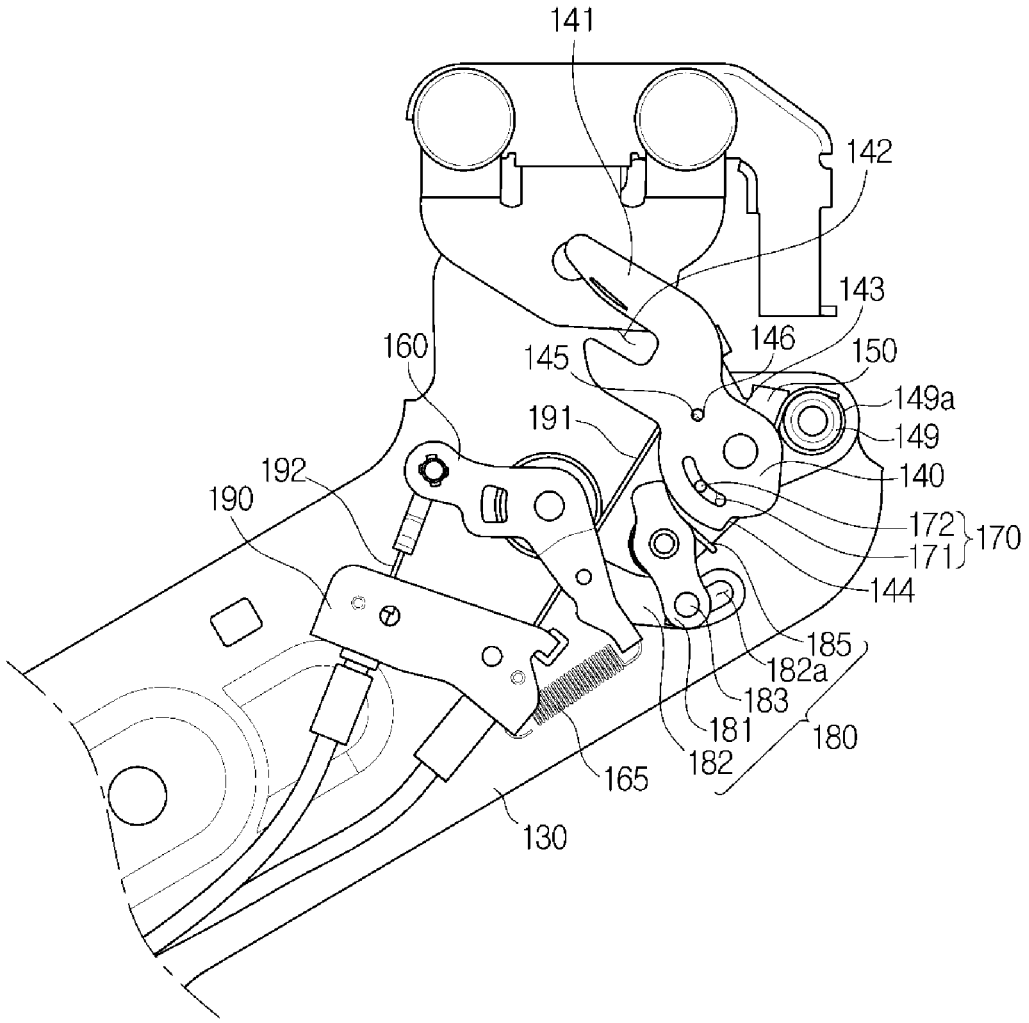
FIG. 6 is a plan view illustrating the locking apparatus 100 of a sliding door according to an embodiment of the present disclosure.
Figure 7:
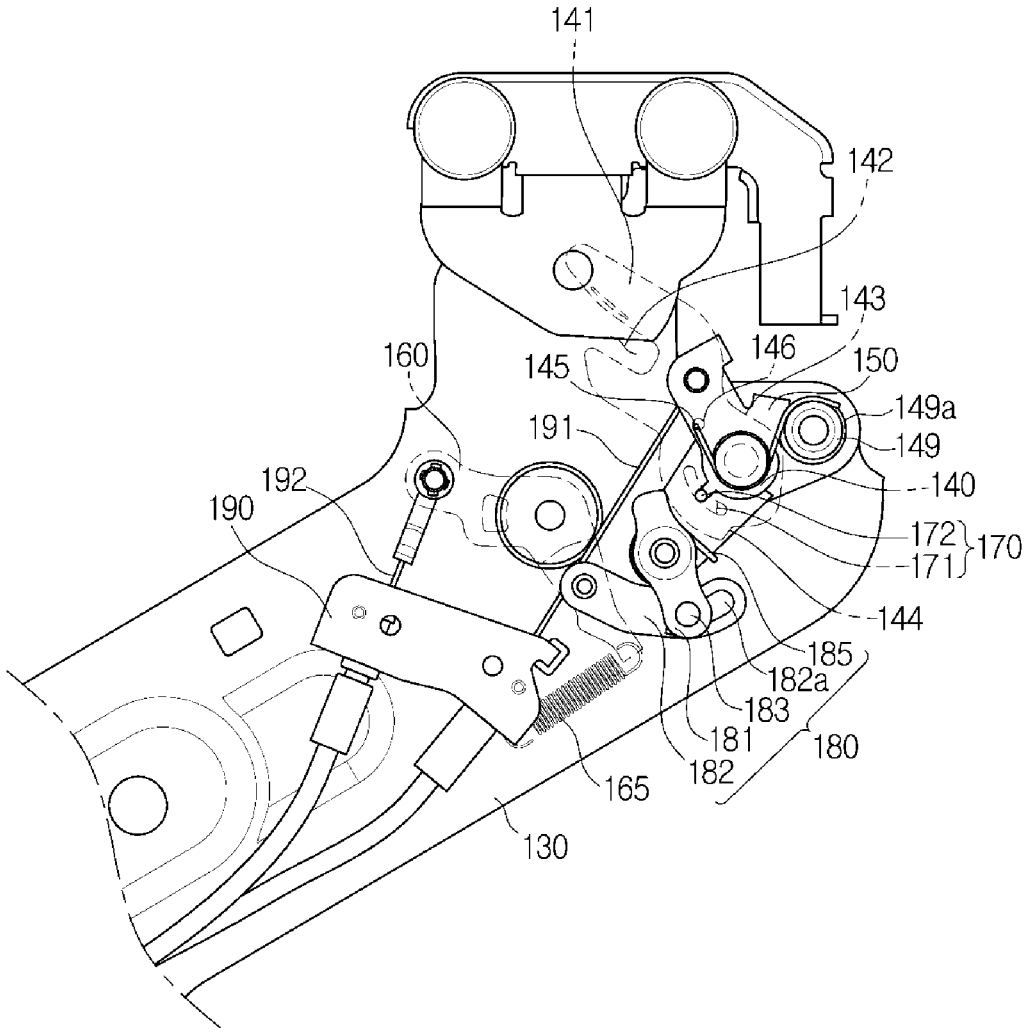
FIG. 7 is a plan view of the locking apparatus 100 shown in FIG. 6 with the locking lever 140 and the connecting lever 160 shown in phantom.

FIG. 3 is a perspective view illustrating the locking apparatus 100 of a sliding door according to an embodiment of the present disclosure. Also, FIG. 4 is a perspective view in a different direction illustrating an enlarged view of the locking apparatus 100 of a sliding door according to an embodiment of the present disclosure, and FIG. 6 is a plan view illustrating the locking apparatus 100 of a sliding door according to an embodiment of the present disclosure. FIG. 5 is a perspective view of the locking apparatus 100 of FIG. 4 with the locking lever 140 and a connecting lever 160 shown in phantom, and FIG. 7 is a plan view of the locking apparatus 100 shown in FIG. 6 with the locking lever 140 and the connecting lever 160 shown in phantom.

Referring to FIGS. 3 to 7, the locking apparatus 100 of a sliding door according to an embodiment of the present disclosure may include a window glass safety stopper 110 and a hold-open lock striker 120 sequentially provided on the vehicle body 1 in the direction in which the sliding door 2 moves from its closed position to its open position (also referred to as "opening direction"). The apparatus 100 may further include a roller bracket 130 provided at the sliding door 2. The locking lever 140 is rotatably provided or mounted at the roller bracket 130 and configured to limit or restrict movement of the sliding door 2 by being locked to the window glass safety stopper 110 or engaged with the hold-open lock striker 120. The apparatus 100 may further include a first elastic member 145 configured to bias the locking lever 140 and a window glass lever 150 connected to the window glass 3 via a first cable 191 and configured to interlock with the locking lever 140 to be rotatably provided or mounted. The apparatus 100 may further include a second elastic member 155 configured to bias the glass window lever 150 and a first interlocker 170 configured to interlock the locking lever 140 with the window glass lever 150. The connecting lever 160 is rotatably provided or mounted at the roller bracket 130, connected to a handle provided at the sliding door 2 via a second cable 192, and configured to interlock with the locking lever 140 to be rotatably provided or mounted. The apparatus 100 may further include a third elastic member 165 configured to bias the connecting lever 160, a second interlocker 180 configured to interlock the locking lever 140 with the connecting lever 160, a lever stopper 149 configured to limit an amount of rotation of the locking lever 140 in one direction (or a first direction), and a cable bracket 190 configured to support the first cable 191 and the second cable 192 on the roller bracket 130.

Meanwhile, rotation in one direction (or the first direction) that will be described in the embodiment refers to clockwise rotation of each of the elements about a rotation axis, and rotation in the other direction (or a second direction) refers to counterclockwise rotation of each of the elements about the rotation axis.

The window glass safety stopper 110 and the hold-open lock striker 120 are sequentially provided adjacent to one another on the vehicle body 1 in the opening direction of the sliding door 2. Since the hold-open lock striker 120 is provided to temporarily maintain the sliding door 2 in its open position, the hold-open lock striker 120 may be provided on the vehicle body 1 at a position corresponding to a position of the locking lever 140, that will be described below, with the sliding door 2 completely open. Also, since the window glass safety stopper 110 is provided to prevent the sliding door 2 from completely opening with the window glass 3 in the opened position, the window glass safety stopper 110 may be provided on the vehicle body 1 at a position corresponding to a position of the locking lever 140, that will be described below, with the sliding door 2 between an opened position and a completely closed position.

The hold-open lock striker 120 may include a striker bracket 121 fixed and supported on the vehicle body 1 and a pole 122 protruding from the striker bracket 121 to be seated on an engagement recess 142 of the locking lever 140 that will be described below. As described above, the striker bracket 121 may be installed on the vehicle body 1 at the position corresponding to the position of the locking lever 140 with the sliding door 2 in the open position, by a fixing element such as a bolt. Also, the striker bracket 121 may be installed near a guide rail (not illustrated), that will be described below, provided on the vehicle body 1 so that a part of the roller bracket 130 is inserted into the rail and slides in the longitudinal direction of the vehicle body 1. The pole 122 may protrude from the striker bracket 121 and may be seated on the engagement recess 142 of the locking lever 140. The pole 122 may take a cylindrical shape. When the pole 122 is seated on the engagement recess 142 of the locking lever 140, the pole 122 may rotate the locking lever 140 in the one direction (the first direction). The locking lever 140 may be restricted from rotating in both of the directions by a latch lever 181 and the lever stopper 149 that will be described below. In this way, the hold-open lock feature of the sliding door 2 is achieved since the movement of the sliding door 2 is restricted in both opening and closing directions. This will be described in detail below.

The window safety stopper 110 may include a stopper bracket 111 fixed at and supported by the vehicle body 1 and a limiter 112 protruding from the stopper bracket 111 to come into contact with a locking protrusion 141 of the locking lever 140 that will be described below. As described above, the stopper bracket 111 may be installed on the vehicle body 1 by a fixing element such as a bolt at the position corresponding to the position of the locking lever 140 when the sliding door 2 is between the opened position and the closed position. Also, the stopper bracket 111 may be installed near the guide rail (not illustrated), that will be described below, on the vehicle body 1 so that the roller bracket 130 slides. The limiter 112 protrudes from the stopper bracket 111 and is configured to be locked to the locking protrusion 141.

When the sliding door 2 is in the open position and the window glass 3 is open, the locking lever 140 that is rotated in the one direction (the first direction) by the window glass lever 150 enters the window glass safety stopper 110, as will be described below. Thus, the window safety lock feature of the sliding door 2 is provided since the movement of the sliding door 2 in the opening direction is limited by the limiter 112 engaging with the locking protrusion 141 of the locking lever 140. This will be described in detail below.

Meanwhile, the pole 122 of the hold-open lock striker 120 may be installed closer to the sliding door 2 than the limiter 112 of the window glass safety stopper 110. The locking lever 140, that will be described below, is formed in a shape such that the locking protrusion 141 protrudes more than the engagement recess 142 toward the vehicle body 1. Thus, corresponding to the above, the pole 122 of the hold-open lock striker 120 engaged with the engagement recess 142 of the locking lever 140 may be installed closer to the sliding door 2 than the limiter 112 of the window glass safety stopper 110 engaged and locked to the locking protrusion 141 of the locking lever 140. In this way, when the sliding door 2 is in the opened position while the window glass 3 is closed and the locking lever 140 is at its original position, the locking lever 140 may pass by the limiter 112 of the glass safety stopper 110. When the sliding door 2 is completely open, the hold-open lock feature of the sliding door 2 may be provided by the rotation of the locking lever 140 in the one direction (the first direction) as the pole 122 of the hold-open lock striker 120 is engaged with the engagement recess 142 of the locking lever 140. This will be described in detail with reference to FIGS. 8 to 15.

The roller bracket 130 is mounted on the sliding door 2. In addition to being mounted on the sliding door 2, a portion of the roller bracket 130 is inserted into the guide rail (not illustrated) to slide. Thus, the roller bracket 130 enables the sliding door 2 to be opened and closed in the longitudinal direction of the vehicle body 1. The roller bracket 130 may be fixed and installed on a chassis, a frame, etc. of the sliding door 2 by a mounting bracket 131. The mounting bracket 131 may be installed on the sliding door 2 by a fixing element such as a bolt.

The locking lever 140 is rotatably provided or mounted at the roller bracket 130 and includes the locking protrusion 141 that interacts with the window glass safety stopper 110 to limit movement of the sliding door 2 in the opening direction. The locking lever 140 also includes the engagement recess 142 that engages with the hold-open lock striker 120 to limit movement of the sliding door 2 in the opening direction and the closing direction.

The locking lever 140 may be rotatably provided or mounted at the same pin on the roller bracket 30, as the window glass lever 150 that will be described below, and may be biased by the first elastic member 145. The locking lever 140 is biased in the other direction (the second direction) by the first elastic member 145 so that the locking lever 140 may remain inserted into the sliding door 2 while the window glass 3 is closed. While the locking lever 140 remains inserted into the sliding door 2, the locking protrusion 141 of the locking lever 140 may pass by the limiter 112 of the window glass safety stopper 110 without being locked thereto. The locking lever 140 interlocks with the window glass lever 150 by the first interlocker 170 to rotate. When the window glass lever 150 rotates in the one direction (the first direction), the locking lever 140 may rotate in the one direction (the first direction) together with the window glass lever 150 and cause the locking protrusion 141 of the locking lever 140 to protrude toward the vehicle body 1. While the locking lever 140 is rotated in the one direction (the first direction) and is protruded toward the vehicle body 1, the locking protrusion 141 of the locking lever 140 may come into contact with and be locked to the limiter 112 of the window glass safety stopper 110.

The locking lever 140 may be formed in a shape in which the locking protrusion 141 protrudes more than the engagement recess 142 toward the vehicle body 1. As described above, the limiter 112 of the window glass safety stopper 110 with which the locking protrusion 141 is locked is installed to be spaced further apart by a predetermined distance from the vehicle body 1 as compared to pole 122 of the hold-open lock striker 120 with which the engagement recess 142 is engaged. Thus, corresponding to the above, the locking protrusion 141 of the locking lever 140 may be formed to protrude more than the engagement recess 142 toward the vehicle body 1.

The locking lever 140 may include a first seating portion 143 configured to contact the latch lever 181 of the second interlocker 180 so that the latch lever 181 is seated thereon and a second seating portion 144 configured to contact the lever stopper 149 so that the lever stopper 149 is seated thereon. Also, the locking lever 140 may have a first slot 171 of the first interlocker 170, that will be described below, formed in an arc shape about the pin 172, which functions as a rotation axis. The reference numeral 146 indicates a through-hole into which an end of the first elastic member 145 is inserted so that elastic force of the first elastic member 145 is transmitted to the locking lever 140.

The window glass lever 150 is rotatably provided or mounted on the roller bracket 130, is connected to the window glass 3 provided at the sliding door 2 via the first cable 191, and interlocks with the locking lever 140 by the first interlocker 170 to rotate.

The first cable 191 has one end connected to the window 3 or a window regulator (not illustrated) and the other end connected to the window glass lever 150. In this way, the first cable 191 may transmit whether the window glass 3 is open or closed or partially opened or closed to the glass lever 150. The first cable 191 may be supported on the roller bracket 130 by the cable bracket 190.

The window glass lever 150 may be rotatably provided or mounted at the same pin 172 on the roller bracket 30 as the locking lever 140 and may be biased by the second elastic member 155. The window glass lever 150 is biased in the one direction (the first direction) by the second elastic member 155 and has one end connected to the first cable 191. In this way, the window glass lever 150 may be pulled by the first cable 191 and rotate in the other direction (the second direction) when the window glass 3 closed. When the window glass 3 open, there may be slack in the first cable 191, the window glass lever 150 may rotate in the one direction (the first direction) by elastic force of the second elastic member 155, and the locking lever 140 may also rotate in the one direction (the first direction) by the first interlocker 170.

The first interlocker 170 may include the first slot 171 provided at the locking lever 140 and the protrusion 172 provided at the window glass lever 150. The protrusion 172 is inserted into the first slot 171 to interlock rotation of the locking lever 140 in the one direction (the first direction) with rotation of the window glass lever 150 when the window glass lever 150 rotates in the one direction (the first direction).

The first slot 171 may be formed in an arc shape about a pin 172 as a central axis, which is a rotational axis of the locking lever 140 and the window glass lever 150. The protrusion 172 may be provided on the window glass lever 150 and have at least a portion inserted into the slot 171. The window glass lever 150 is elastically supported in the one direction (the first direction) by the second elastic member 155 and the protrusion 172 is inserted into the first slot 171 provided at the locking lever 140. As a result, when there is slack in the first cable 191 and the window glass lever 150 rotates in the one direction (the first direction) by the elastic force of the second elastic member 155 due to the window glass 3 being open, the protrusion 172 may restrict rotation of the locking lever 140 in the one direction (the first direction) by the first slot 171 and interlock rotations of the window glass lever 150 and the locking lever 140 in the one direction (the first direction). Conversely, when the first cable 191 is pulled and the window glass lever 150 rotates in the other direction (the second direction) due to the window glass 3 being closed while the locking protrusion 141 of the locking lever 140 is locked to the limiter 112 of the window glass safety stopper 110 and the locking lever 140 is rotated in the one direction (the first direction), the protrusion 172 may slide along the first slot 171 so that only the window glass lever 150 rotates in the other direction (the second direction) and the locking lever 140 remains rotated in the one direction (the first direction).

Also, when the sliding door 2 is open while the window glass 3 is closed and the pole 122 of the hold-open lock striker 120 is engaged with the engagement recess 142 of the locking lever 140, movement of the locking lever 140 may be prevented by the interaction of the protrusion 172 of the window glass lever 150 with the slot 171 and may stably rotate in the one direction (the first direction) to provide the hold-open lock feature of the sliding door 2. Further, while the pole 122 of the hold-open lock striker 120 is engaged with the engagement recess 142 of the locking lever 140, i.e., while the hold-open lock feature of the sliding door 2 is used, the protrusion 172 of the window glass lever 150 slides along the first slot 171 even when there is slack in the first cable 191 and the window glass lever 150 rotates in the one direction (the first direction) due to the window glass 3 being open. Thus, the window glass lever 150 may rotate independently from the locking lever 140 that has already rotated in the one direction (the first direction).

As described above, rotation of the window glass lever 150 is interlocked to rotation of the locking lever 140, but, due to the structure of the first slot 171 and the protrusion 172, rotation of the window glass lever 150 in the one direction (the first direction) is interlocked to the locking lever 140 only when the locking lever 140 is biased in the other direction (the second direction) and is inserted into the sliding door 2. In this way, the window glass safety lock feature of the sliding door 2 may be effectively provided, and the locking lever 140 and the window glass lever 150 may be smoothly and stably operated without interfering with one another in the various operating situations of the sliding door 2 and the window glass 3.

The connecting lever 160 is rotatably provided or mounted at the roller bracket 130, has one end connected to the handle 4 provided at the sliding door 2 via the second cable 192, and is interlocked to the locking lever 140 by the second interlocker 180, that will be described below, to rotate.

The second cable 192 has one end connected to the handle 4 configured to open and close the sliding door 2 and the other end connected to one end of the connecting lever 160. In this way, the second cable 192 may transmit whether the handle is operated to the connecting lever 160. Like the first cable 191, the second cable 192 may be supported on the roller bracket 130 by the cable bracket 190.

The connecting lever 160 may be rotatably mounted on the roller bracket 130 and biased by the third elastic member 165. The third elastic member 165 may have one end fixed on the cable bracket 190 and the other end connected to the other end of the connecting lever 160, i.e., an opposite side of one end connected to the second cable 192 with respect to the rotation axis of the connecting lever 160. In this way, the third elastic member 165 may bias the connecting lever 160 in the one direction (the first direction). The connecting lever 160 is biased by the third elastic member 165 in the one direction (the first direction) and has one end connected to the second cable 192. In this way, when the handle 4 of the sliding door 2 is operated, one end of the connecting lever 160 is pulled by the second cable 192 and rotates in the other direction (the second direction). The rotation of the connecting lever 160 is interlocked to the rotation of the locking lever 140 to enable the locking lever 140, that has been rotated in the one direction (the first direction) by the pole 122 of the hold-open lock striker 120 or the limiter 112 of the window glass safety stopper 110, to rotate in the other direction (the second direction).

The second interlocker 180 is rotatably provided or mounted at the roller bracket 130 and may include the latch lever 181 having one end coming in contact with or spaced apart from the locking lever 140 to restrict or allow rotation of the locking lever 140 in the other direction (the second direction). The second interlocker 180 may further include a first intermediary member 182, a second intermediary member 183, and a fourth elastic member 185 configured to bias the latch lever 181 in the one direction (the first direction). The first intermediary member 182 has one end rotatably connected to the other end of the connecting lever 160 and a second slot 182*a* provided at the other end. The second intermediary member 183 is rotatably connected to the other end of the latch lever 181 and provided to be rotatable in the second slot 182*a*.

The latch lever 181 is rotatably provided or mounted at the roller bracket 130. One end of the lever 181 comes into contact with or is spaced apart from the first seating portion 143 of the locking lever 140 and the other end is connected to the second intermediary member 183 and is freely rotatable. The one end of the latch lever 181 may come into contact with and be seated on the first seating portion 143 of the locking lever 140 and may limit rotation of the locking lever 140 in the other direction (the second direction) or may be spaced apart from the locking lever 140 and allow or release restriction of rotation of the locking lever 140 in the other direction (the second direction). The latch lever 181 is biased in the one direction (the first direction) by the fourth elastic member 185 so that the one end of the latch lever 181 remains in contact with the locking lever 140.

Thus, when the pole 122 of the hold-open lock striker 120 is engaged with the engagement recess 142 of the locking lever 140 and the locking lever 140 is rotated in the one direction (the first direction) from its original position, the latch lever 181 that has been biased by the fourth elastic member 185 comes into contact with and is seated on the first seating portion 143 of the locking lever 140 and restricts or limits restoration of the locking lever 140, that is rotated in the one direction (the first direction), in the other direction (the second direction), thereby realizing the hold-open lock feature of the sliding door 2. Also, even when the limiter 112 of the window glass safety stopper 110 is locked to the locking protrusion 141 of the locking lever 140 and the locking lever 140 is rotated in the one direction (the first direction) from its original position, the latch lever 181 may come into contact with and be seated on the first seating portion 143 of the locking lever 140 and restrict or limit the locking lever 140 from being restored in the other direction (the second direction).

Conversely, a configuration in which the latch lever 181 is spaced apart from the locking lever 140 and releases or allows the locking lever 140 to be restored in the other direction (the second direction) will be described in detail in descriptions of the first intermediary member 182 and the second intermediary member 183 below.

The connecting lever 160 rotates in the other direction (the second direction) or the one direction (the first direction) according to the second cable 192 pulling or having a slack by an operation of the handle. The first intermediary member 182 and the second intermediary member 183 are provided to transmit rotation of the connecting lever 160 to the latch lever 181.

The first intermediary member 182 may have one end rotatably connected to the other end of the connecting lever 160 and the second slot 182*a* provided at the other end. The second intermediary member 183 may be rotatably connected to the other end of the latch lever 181, i.e., opposite side of one end near the locking lever 140 with respect to the rotational axis of the latch lever 181, and may be rotatable in the second slot 182*a*. The second slot 182*a* at the other end of the first intermediary member 182 is provided to prevent operational interference between the connecting lever 160 and the second interlocker 180 and enable smooth operations between elements. For example, while both of the window glass 3 and the sliding door 2 are closed, the locking lever 140 rotates in the other direction (the second direction) by the first elastic member 145 and is placed at its original position, and the latch lever 181 is biased in the one direction (the first direction) by the fourth elastic member 185 while remaining spaced apart from the first seating portion 143 and in contact with the locking lever 140 (refer to FIG. 6). When the first intermediary member 182 is immediately connected to the second intermediary member 183 in the above state, the connecting lever 160 rotates in the other direction (the second direction) when the handle 4 is operated to open the sliding door 2, and accordingly, movement of the first intermediary member 182 may be immediately transmitted to the latch lever 181 via the second intermediary member 183. Further, operational interference may occur between the connecting lever 160 and the second interlocker 180 or an unnecessary load may be generated at the fourth elastic member 185. Thus, the second slot 182*a* is formed at the first intermediary member 182, and the second intermediary member 183 is connected to the other end of the latch lever 181 to be freely rotatable in the second slot 182*a*. In this way, operations of the handle 4, the second cable 192, the connecting lever 160, the first intermediary member 182, and the second intermediary member 183 occur in sequence only when the glass safety lock feature or the hold-open lock feature is disabled, so that the latch lever 181 is stably operated.

The lever stopper 149 limits an amount of rotation of the locking lever 140 in the one direction (the first direction). As described above, the locking lever 140 rotates in the one direction (the first direction) from its original position by the window glass lever 150 when the window glass 3 is open. Here, when the rotation of the locking lever 140 in the one direction (the first direction) is not limited, movement of the sliding door 2 in the opening direction cannot be limited, and the window glass safety lock feature cannot be stably performed. Thus, due to the lever stopper 149 limiting the degree of rotation of the locking lever 140 in the one direction (the first direction), the locking lever 140 is locked to the limiter 112 of the window glass safety stopper 110 and may limit the movement of the sliding door 2 in the opening direction. The lever stopper 149 may come into contact with and be seated on the second seating portion 144 of the locking lever 140. A damper 149*a* configured to reduce noise caused by operation and attenuate impact due to contact between the lever stopper 149. The locking lever 140 may be provided at an outer surface where the lever stopper 149 comes into contact with the locking lever 140.

FIGS. 8 to 11 are plan views sequentially illustrating steps for providing the window glass safety lock feature by the locking apparatus 100 for a sliding door according to an embodiment of the present disclosure. Hereinafter, operation of the locking apparatus 100 for a sliding door according to an embodiment of the present disclosure for providing the glass safety lock feature will be described with reference to FIGS. 8 to 11.

Figure 8:
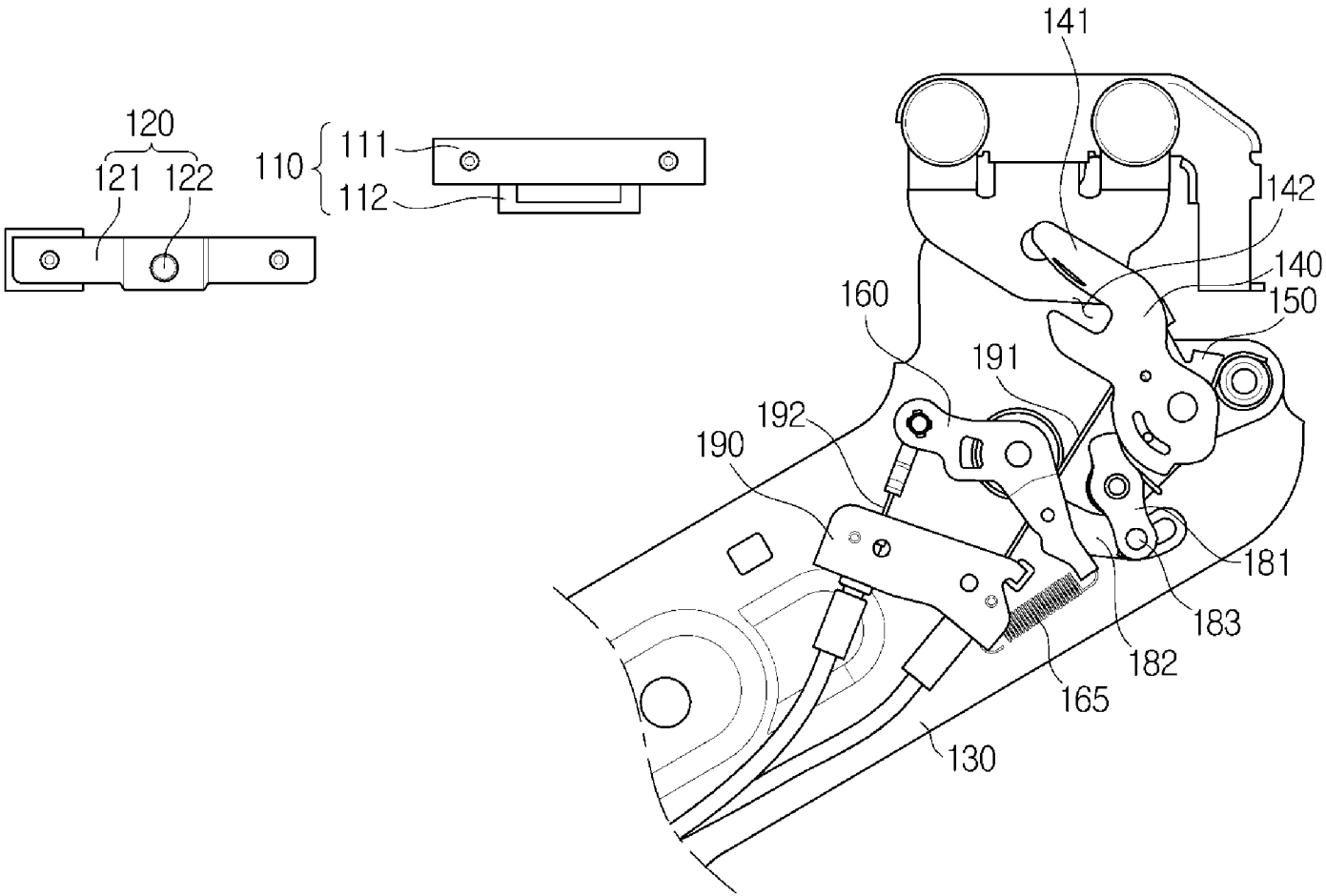
FIGS. 8 to 11 are plan views illustrating in sequence the steps of the glass safety lock feature of the locking apparatus 100 for a sliding door according to an embodiment of the present disclosure.

Referring to FIG. 8, while the sliding door 2 and the window glass 3 are closed, the locking lever 140 is biased in the other direction (the second direction) by the first elastic member 145 and is placed at its original position. Further, the window glass lever 150 is biased in the one direction (the first direction) by the second elastic member 155 and remains pulled by the first cable 191 connected to the window glass 3.

Figure 9:
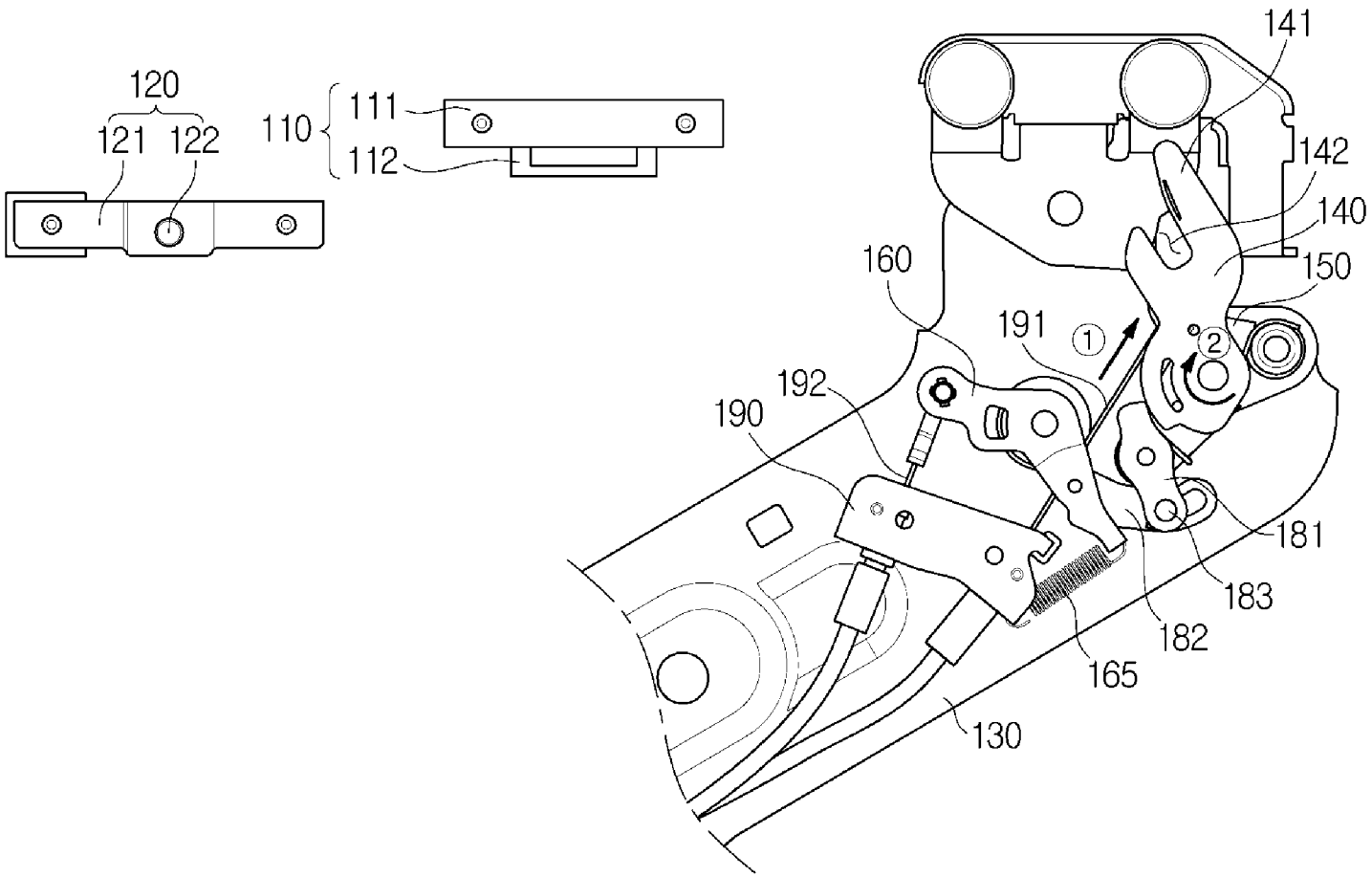

The first cable 191 has a slack in the direction denoted by arrow 1 in FIG. 9 and the window glass lever 150 is biased by the second elastic member 155 when the window glass 3 is opened. Thus, the window glass lever 150 rotates in the one direction (the first direction) (denoted by arrow 2 in FIG. 9), and the locking lever 140 also rotates in the one direction (the first direction) (denoted by arrow 2 in FIG. 9) together with the window glass lever 150 due to the first interlocker 170.

Figure 10:
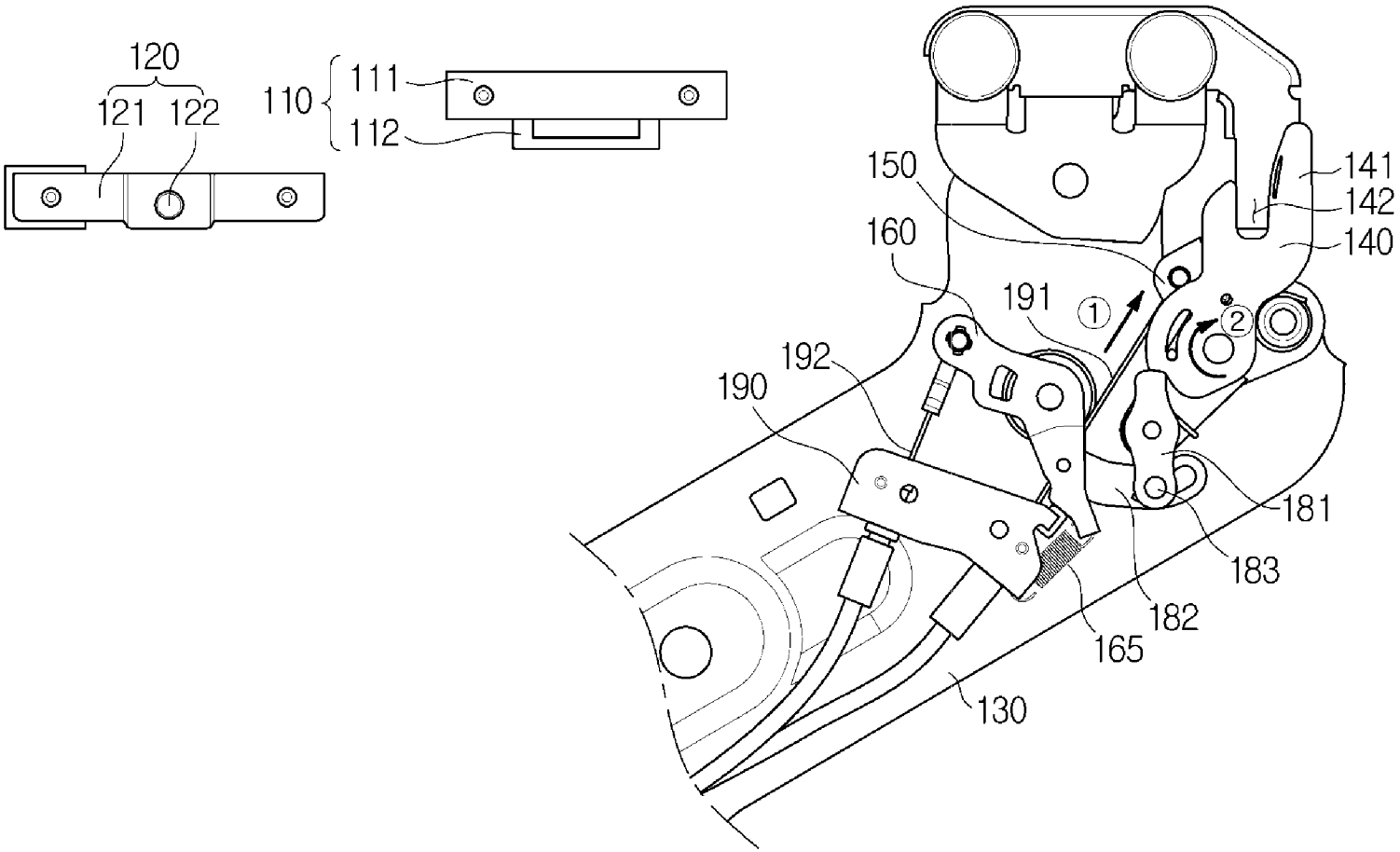
Figure 11:
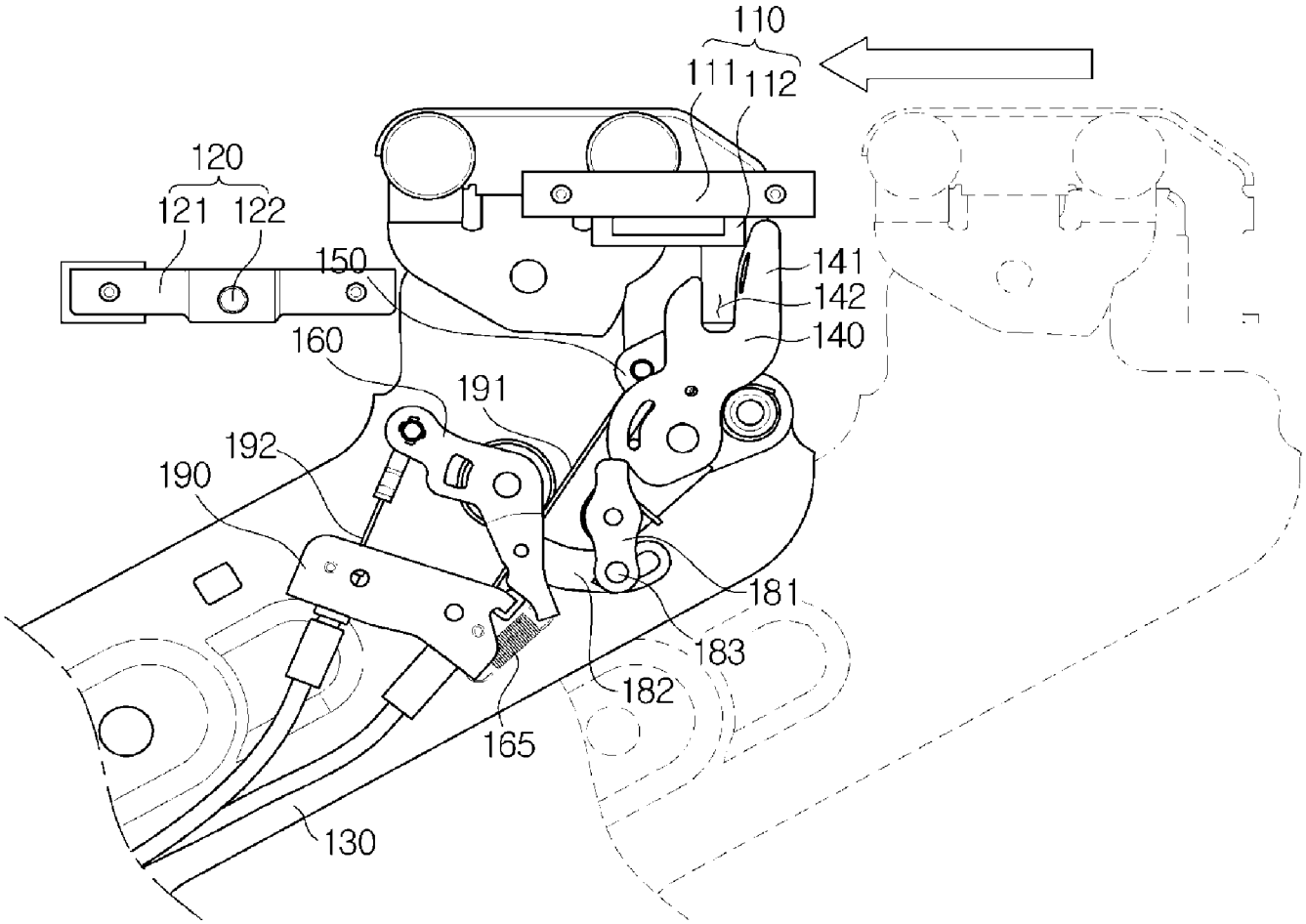

As shown in FIG. 10, the first cable 191 has a greater slack in direction 1 due to the window glass 3 being open. Accordingly, each of the window glass lever 150 and the locking lever 140 further rotates in the one direction (the first direction) along direction 2 in FIG. 10, and the locking protrusion 141 of the locking lever 140 is completely protruded toward the vehicle body 1. Here, further rotation of the locking lever 140 in the one direction (the first direction) is limited by the lever stopper 149.

When the sliding door 2 is open in the above state, the locking protrusion 141 of the locking lever 140 is locked to the limiter 112 of the window glass safety stopper 110 provided at the vehicle body 1 so that movement of the sliding door 2 in the opening direction is limited and the glass safety lock feature is realized.

FIGS. 12 to 15 are plan views sequentially illustrating steps for providing the hold-open lock feature by the locking apparatus 100 for a sliding door according to an embodiment of the present disclosure. Hereinafter, operation of the locking apparatus 100 for a sliding door according to an embodiment of the present disclosure for providing the hold-open lock feature will be described with reference to FIGS. 12 to 15.

Figure 12:
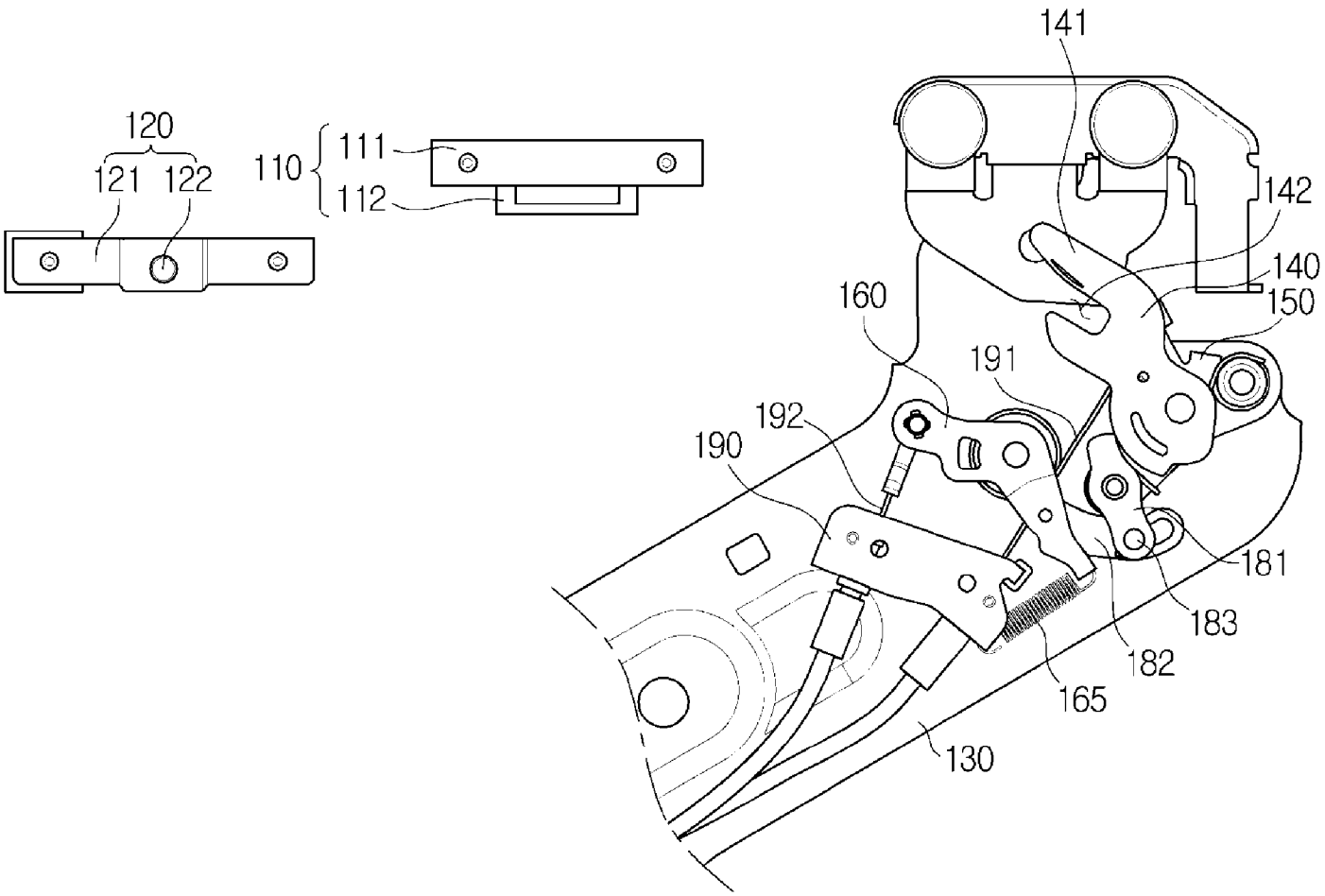
FIGS. 12 to 15 are plan views illustrating in sequence the steps of the hold-open lock feature by the locking apparatus 100 for a sliding door according to an embodiment of the present disclosure.

Referring to FIG. 12, while the sliding door 2 and the window glass 3 are closed, the locking lever 140 is biased in the other direction (the second direction) by the first elastic member 145 and is placed at its original position. The glass lever 150 is biased in the one direction (the first direction) by the second elastic member 155 and is pulled by the first cable 191 connected to the window glass 3.

Figure 13:
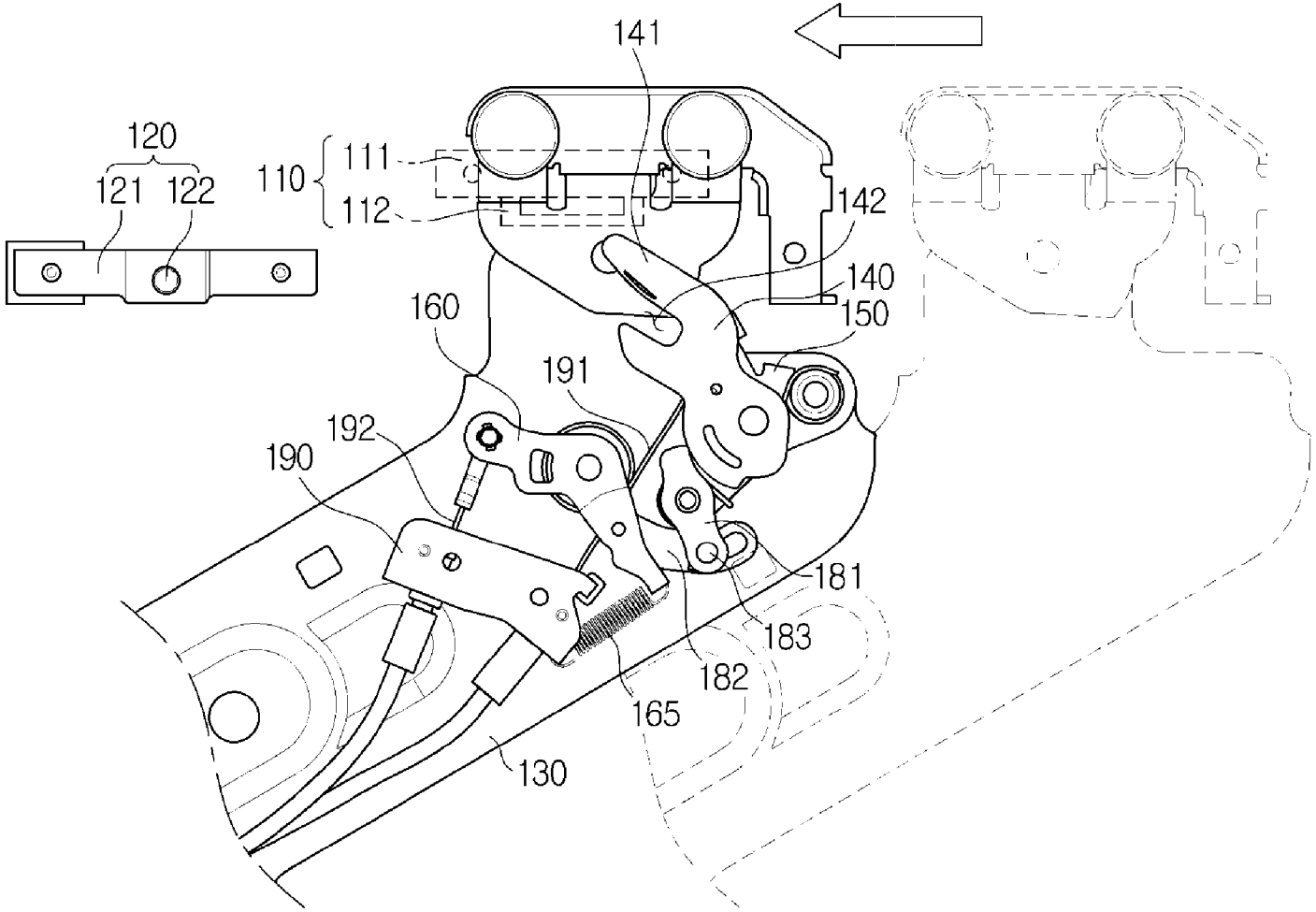

When the sliding door 2 is open while the window glass 3 remains closed, as illustrated in FIG. 13, the sliding door 2 is open while the glass lever 150 pulled by the first cable 191 remains at its original position and the locking lever 140 also remains at its original position. Thus, the locking lever 140 passes by the limiter 112 of the glass safety stopper 110 without the locking protrusion 141 of the locking lever 140 being locked to the limiter 112.

Figure 14:
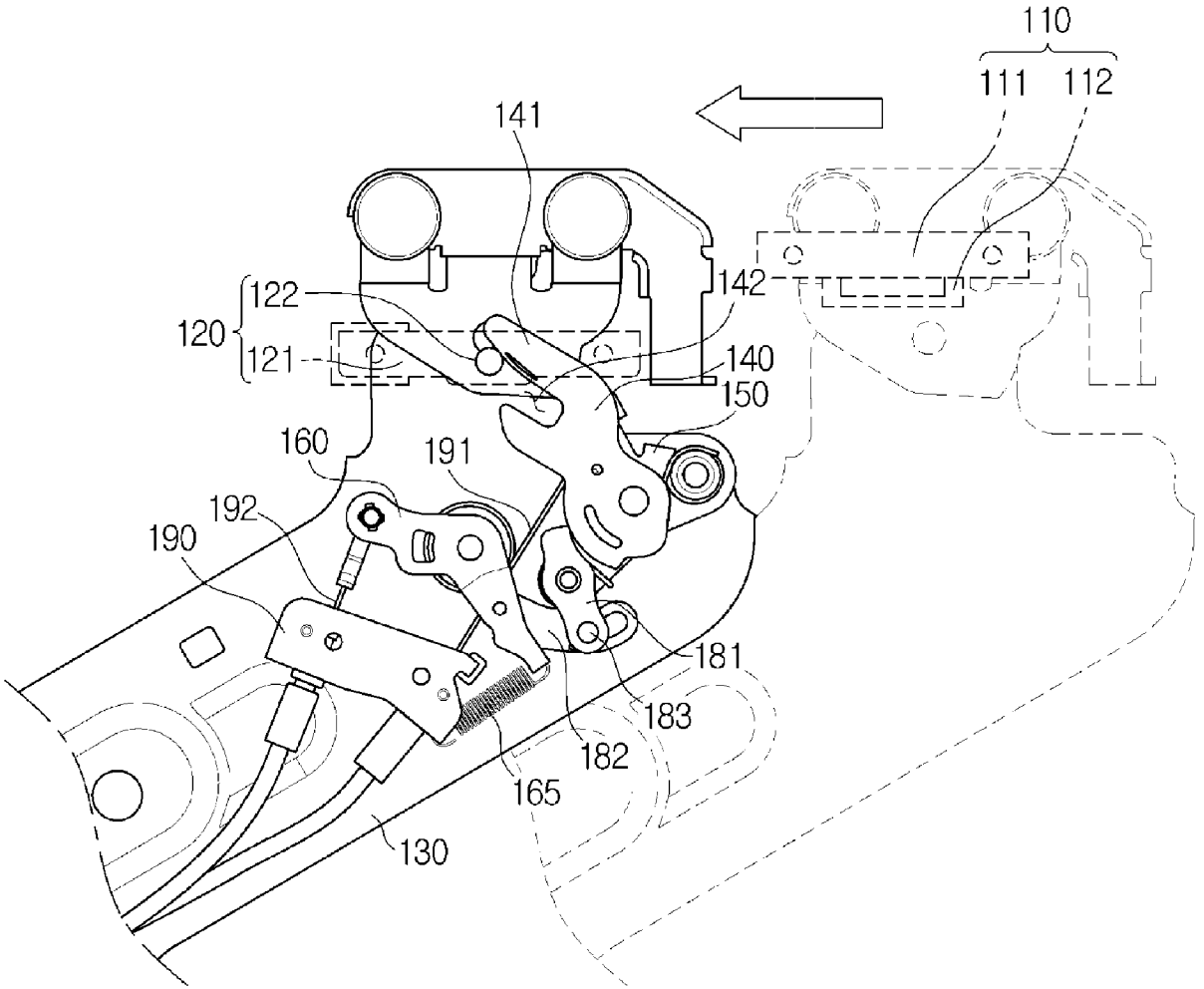
Figure 15:
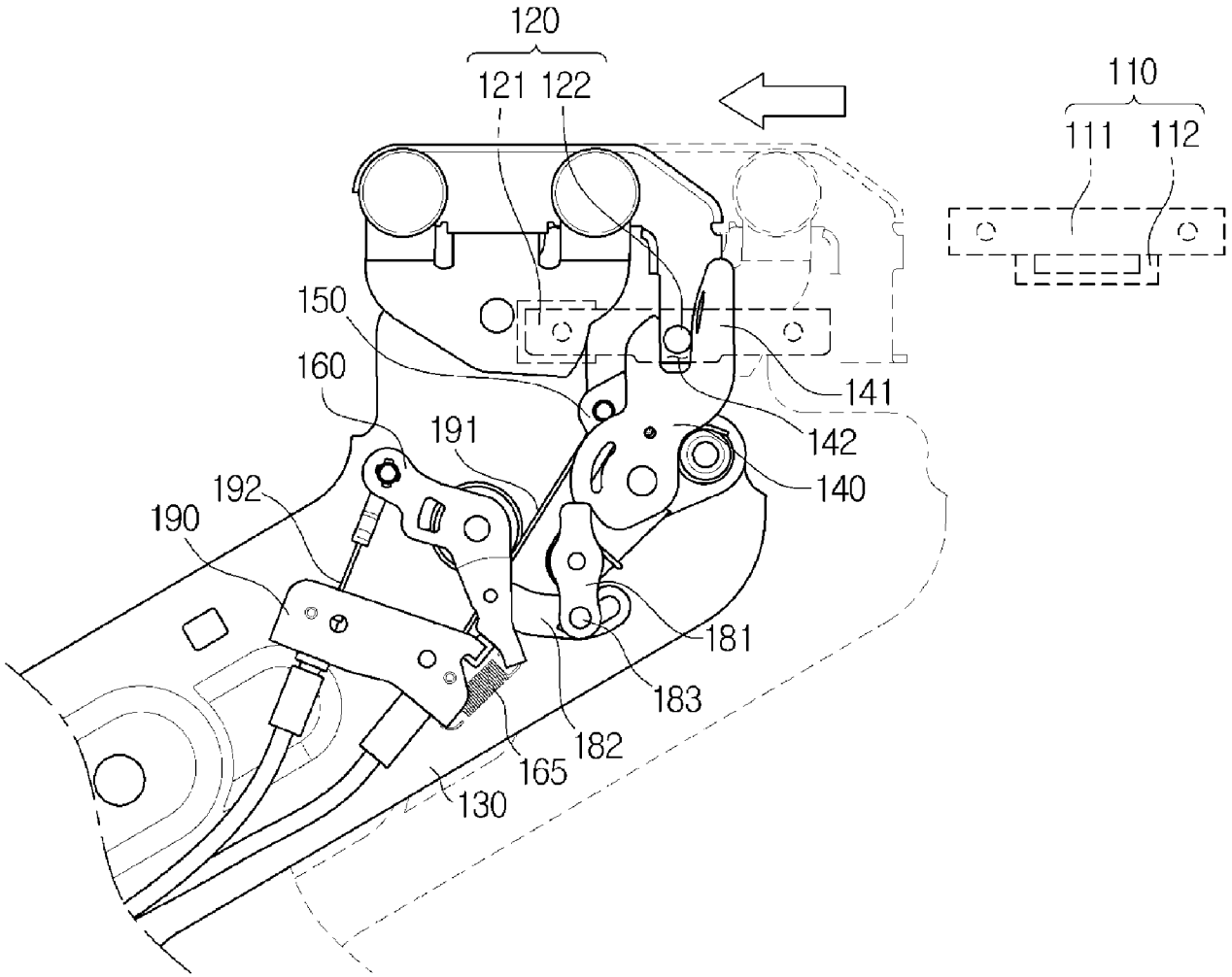

When the sliding door 2 is close to the completely open state, the pole 122 of the hold-open lock striker 120 begins to enter the engagement protrusion 142 of the locking lever 140 as illustrated in FIG. 14.

Then, when the sliding door 2 is at the completely open state, the pole 122 of the hold-open lock striker 120 is completely engaged with the engagement recess 142 of the locking lever 140. Further rotation of the locking lever 140 in the one direction (the first direction) is limited by the lever stopper 149, and movement of the sliding door 2 in the opening direction is limited. Simultaneously, the latch lever 181 of the second interlocker 180 biased in the one direction (the first direction) by the fourth elastic member 185 comes into contact with and becomes seated on the first seating portion 143 of the locking lever 140. Thus, rotation of the locking lever 140 in the other direction (the second direction) is limited and restricted. In this way, movement of the sliding door 2 in the closing direction is limited, and the hold-open lock feature of the sliding door 2 is realized.

Figure 16:
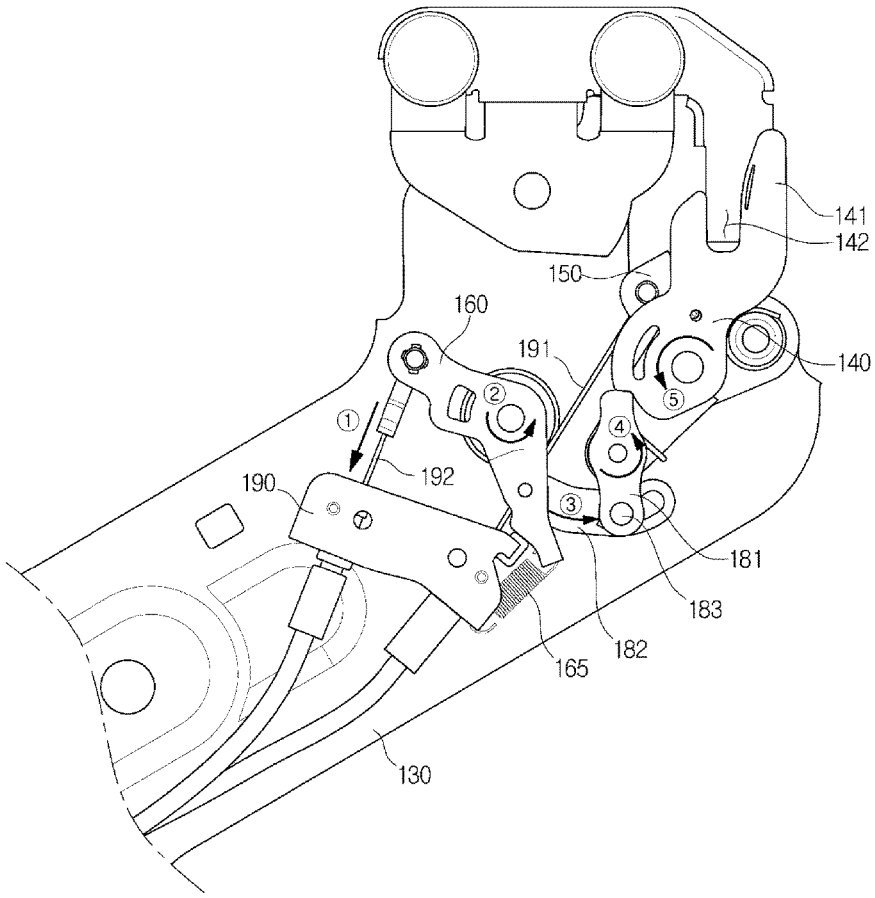
FIG. 16 is a plan view illustrating the disabling of the glass safety lock feature or the hold-open lock feature by the locking apparatus 100 of a sliding door according to an embodiment of the present disclosure.

FIG. 16 is a plan view illustrating an operation of disabling the glass safety lock feature or the hold-open lock feature by the locking apparatus 100 of a sliding door according to an embodiment of the present disclosure. Hereinafter, an operation of the locking apparatus 100 of a sliding door according to an embodiment of the present disclosure for disabling the glass safety lock feature or the hold-open lock feature will be described with reference to FIG. 16.

Restoration of the locking lever 140 to its original position is restricted or limited by the latch lever 181 when the locking protrusion 141 of the locking lever 140 is locked to the limiter 112 of the window glass safety stopper 110 and the glass safety lock feature is realized or when the pole 122 of the hold-open lock striker 120 is engaged with the engagement recess 142 of the locking lever 140 and the hold-open lock feature is realized.

To disable any of these features, the second cable 192 is pulled in the direction denoted by arrow 1 in FIG. 16 when the handle of the sliding door 2 is operated, and accordingly, the connecting lever 160 rotates in the other direction (the second direction)(denoted by arrow 2 in FIG. 16). Due to rotation of the connecting lever 160 in the second direction (denoted by arrow 2 in FIG. 16), the first intermediary member 182 is pushed in the direction denoted by arrow 3 in FIG. 16, and the latch lever 181 rotates in the other direction denoted by arrow 4 in FIG. 16 via the second intermediary member 183 connected to the second slot **182*a* of the first intermediary member 182. In this way, restriction of rotation of the locking lever 140, biased in the other direction (the second direction) by the first elastic member 145, is released, and the locking lever 140 rotates in the direction denoted by arrow 5 in FIG. 16** and is restored to its original position so that the window glass safety lock feature or the hold-open lock feature is disabled.

The locking apparatus 100 for a sliding door according to an embodiment of the present disclosure having the above configuration may simultaneously realize the glass safety lock feature and the hold-open lock feature of the sliding door 2 by the locking lever 140, which is a single member. Thus, due to the structure, it may be easy to manufacture, install, maintain, and repair the product.

Also, the weight of the product may be reduced because the number of parts may be considerably decreased. Moreover, manufacturing cost of the product may be reduced, space utilization of a vehicle may be improved because the product may be miniaturized, and design flexibility of the vehicle and the sliding door 2 may be improved. Further-more, market competitiveness of the vehicle may be increased by improving convenience and safety of a passenger.

A locking apparatus for a sliding door according to an embodiment of the present disclosure has an effect of effectively performing a hold-open lock feature and a window glass safety lock feature of the sliding door by employing a single structure, the locking lever.

A locking apparatus for a sliding door according to an embodiment of the present disclosure has an effect of ease of manufacturing, installation, maintenance, and repair due to decreased number of parts for simultaneously implementing a hold-open lock feature and a glass safety lock feature of the sliding door.

A locking apparatus for a sliding door according to an embodiment of the present disclosure has an effect of improving convenience and safety of a passenger by preventing the sliding door from closing or opening by itself due to a self-load and preventing the sliding door from completely opening while a window glass is open.

A locking apparatus for a sliding door according to an embodiment of the present disclosure has an effect of reducing weight of a vehicle and improving operating convenience of a passenger by reducing weight of the product.

A locking apparatus for a sliding door according to an embodiment of the present disclosure has effects of improving space utilization of a vehicle and improving design flexibility of a vehicle body and the sliding door by being easily installed even in a narrow space between the vehicle body and the sliding door.

A locking apparatus for a sliding door according to an embodiment of the present disclosure has decreased manufacturing cost and improved productivity.

A locking apparatus for a sliding door according to an embodiment of the present disclosure has improved performance and operational reliability for implementing a hold-open lock feature and a glass safety lock feature of the sliding door.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A locking apparatus for a sliding door of a vehicle, the locking apparatus comprising:

a window glass safety stopper and a hold-open lock striker sequentially provided in a body of the vehicle in an opening direction of the sliding door as the sliding door moves from a closed position to an open position;

a roller bracket provided at the sliding door;

a locking lever rotatably provided on the roller bracket and having a locking protrusion configured to be locked to the window glass safety stopper to limit movement of the sliding door in the opening direction and an engagement recess configured to be engaged with the hold-open lock striker to limit movement of the sliding door in the opening direction and a closing direction;

a first elastic member configured to bias the locking lever;

a window glass lever rotatably provided on the roller bracket, connected to a window glass provided at the sliding door via a first cable, and configured to interlock with the locking lever;

a second elastic member configured to bias the window glass lever; and a connecting lever rotatably provided on the roller bracket, connected to a handle provided at the sliding door via a second cable, and configured to interlock with the locking lever.

2. The locking apparatus of claim 1, further comprising a first interlocker configured to interlock the locking lever with the window glass lever, wherein the first interlocker includes a first slot provided at the locking lever and a protrusion provided at the window glass lever and inserted into the first slot to interlock rotation of the locking lever in one direction with rotation of the window glass lever when the window glass lever rotates in the one direction.

3. The locking apparatus of claim 2, further comprising a third elastic member configured to bias the connecting lever.

4. The locking apparatus of claim 3, further comprising a second interlocker configured to interlock the locking lever with the connecting lever, wherein the second interlocker is rotatably provided at the roller bracket and includes a latch lever having one end configured to restrict or allow rotation of the locking lever in another direction, a first intermediary member having one end rotatably connected to the other end of the connecting lever and a second slot provided at the other end, and a second intermediary member rotatably connected to the other end of the latch lever and configured to be rotatable in the second slot.

5. The locking apparatus of claim 4, wherein the second interlocker further includes a fourth elastic member configured to bias the latch lever.

6. The locking apparatus of claim 5, further comprising a lever stopper configured to limit an amount of rotation of the locking lever.

7. The locking apparatus of claim 6, wherein the locking lever includes a first seating portion configured to contact the latch lever and a second seating portion configured to contact the lever stopper.

8. The locking apparatus of claim 6, wherein the lever stopper includes a damper configured to attenuate an impact due to contact with the locking lever.

9. The locking apparatus of claim 1, further comprising a cable bracket configured to support the first cable and the second cable on the roller bracket.

10. The locking apparatus of claim 9, wherein:

the hold-open lock striker is provided on the vehicle body at a position corresponding to a position of the locking lever when the sliding door is in the open position; and the window glass safety stopper is provided on the vehicle body at a position corresponding to a position of the locking lever when the sliding door is between the open position and the closed position.

11. The locking apparatus of claim 10, wherein the hold-open lock striker includes a striker bracket supported by the vehicle body and a pole protruding from the striker bracket configured to be seated in the engagement recess.

12. The locking apparatus of claim 11, wherein the window glass safety stopper includes a stopper bracket supported by the vehicle body and a limiter protruding from the stopper bracket configured to contact the locking protrusion.

13. The locking apparatus of claim 12, wherein the locking protrusion is positioned closer to the vehicle body than the engagement recess.

14. A locking apparatus for a sliding door of a vehicle, the sliding door having a window with a window glass movable between an open position and a closed position, the locking apparatus comprising:

a window glass safety stopper and a hold-open lock striker sequentially provided in a body of the vehicle in an opening direction of the sliding door as the sliding door moves from a closed position to an open position;

a roller bracket provided at the sliding door;

a locking lever rotatably provided at the roller bracket, having a locking protrusion configured to be locked to the window glass safety stopper to limit movement of the sliding door in the opening direction and an engagement recess configured to be engaged with the hold-open lock striker to limit movement of the sliding door in the opening direction and a closing direction, and configured to rotate in a first direction to protrude toward the vehicle body while the window glass is open so that the locking protrusion is locked to the window glass safety stopper;

a first elastic member configured to bias the locking lever in a second direction to be inserted into the sliding door;

a window glass lever rotatably provided at the roller bracket, connected to the window glass via a first cable, and configured to interlock with the locking lever when the window glass is open so that the locking lever rotates in the first direction; and a second elastic member configured to bias the window glass lever in the first direction.

15. The locking apparatus of claim 14, wherein, with the window glass closed, the locking lever passes by the window glass safety stopper, with the hold-open lock striker engaged with the engagement recess thereof, and rotates in the first direction.

16. The locking apparatus of claim 15, further comprising a connecting lever rotatably provided on the roller bracket, having a first end connected to a handle provided at the sliding door via a second cable, and configured to interlock with the locking lever.

17. The locking apparatus of claim 16, further comprising a first interlocker, wherein the first interlocker includes a first slot provided at the locking lever and a protrusion provided at the window glass lever and inserted into the first slot to interlock rotation of the locking lever in the first direction with rotation of the window glass lever when the window glass lever rotates in the first direction.

18. The locking apparatus of claim 17, further comprising a third elastic member configured to bias the connecting lever in the first direction.

19. The locking apparatus of claim 18, further comprising a second interlocker configured to interlock the locking lever with the connecting lever, wherein the second interlocker is rotatably provided at the roller bracket and includes a latch lever having a first end configured to restrict or allow rotation of the locking lever in the second direction while the first end of the latch lever is in contact with the locking lever and the locking lever is rotated in the first direction, a first intermediary member having a first end rotatably connected to a second end of the connecting lever and a second slot provided at a second end of the first intermediary member, and a second intermediary member rotatably connected to a second end of the latch lever and provided to be rotatable in the second slot.

20. The locking apparatus of claim 19, wherein the second interlocker further includes a fourth elastic member configured to bias the latch lever in the first direction.

21. The locking apparatus of claim 20, further comprising a lever stopper configured to limit an amount of rotation of the locking lever in the first direction.

22. The locking apparatus of claim 21, wherein the locking lever includes a first seating portion configured to contact the latch lever and a second seating portion configured to contact the lever stopper.

23. The locking apparatus of claim 22, wherein the hold-open lock striker includes a striker bracket supported by the vehicle body and a pole protruding from the striker bracket to be seated on the engagement recess.

24. The locking apparatus of claim 23, wherein the window glass safety stopper includes a stopper bracket supported by the vehicle body and a limiter protruding from the stopper bracket to contact the locking protrusion.

25. The locking apparatus of claim 24, wherein the locking protrusion is positioned to be closer to the vehicle body than the engagement recess.

26. The locking apparatus of claim 25, wherein the lever stopper includes a damper configured to attenuate an impact due to contact with the locking lever.

27. The locking apparatus of claim 16, further comprising a cable bracket configured to support the first cable and the second cable on the roller bracket.

* * * * *